US006995308B2

(12) United States Patent
Nishida et al.

(10) Patent No.: US 6,995,308 B2
(45) Date of Patent: Feb. 7, 2006

(54) ELECTRIC KEYBOARD ASSEMBLY AND METHOD OF MANUFACTURING WEIGHT MEMBERS PROVIDED IN KEYBOARD ASSEMBLY

(75) Inventors: Kenichi Nishida, Hamamatsu (JP); Naohisa Mori, Hamamatsu (JP); Hideki Ishihara, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 93 days.

(21) Appl. No.: 09/802,499

(22) Filed: Mar. 9, 2001

(65) Prior Publication Data

US 2001/0037723 A1 Nov. 8, 2001

(30) Foreign Application Priority Data

Mar. 10, 2000 (JP) ..... 2000-066348

(51) Int. Cl.
*G10H 1/34* (2006.01)

(52) U.S. Cl. ..... 84/439; 84/238

(58) Field of Classification Search ..... 84/743, 84/236–242, 744–745, 423 R, 439, 719, 84/432

See application file for complete search history.

(56) References Cited

U.S. PATENT DOCUMENTS 2,800,827 A * 7/1957 Haselton ..... 84/404
4,273,017 A 6/1981 Dodds et al.
5,003,859 A * 4/1991 Monte et al. ..... 84/423 R
5,158,003 A * 10/1992 Lee ..... 84/439
5,574,241 A * 11/1996 Kumano et al. ..... 84/439
5,796,023 A * 8/1998 Kumano et al. ..... 84/433
5,932,825 A 8/1999 Kumano et al.

FOREIGN PATENT DOCUMENTS

| | | |
|---|---|---|
| JP | 5113787 | 5/1993 |
| JP | 8-3144441 | 11/1996 |
| JP | 9244623 | 9/1997 |
| JP | 11265177 | 9/1999 |

* cited by examiner

*Primary Examiner*—Marlon T. Fletcher
*Assistant Examiner*—David S. Warren
(74) *Attorney, Agent, or Firm*—Morrison & Foerster, LLP

(57) ABSTRACT

There is provided an electric keyboard assembly having a construction which is capable of reducing a height of a keyboard and at the same time facilitating key scaling to key-touch response while maintaining the degree of freedom in designing the keyboard. A key is pivotally moved by a key depressing operation. A seesaw-type mass member having a front extension and a rear extension each extending from a pivot-receiving portion thereof, and a tone-generating position adjustment screw fitted in the front extension is pivotally moved about the pivot-receiving portion by a driving force generated by depression of the key and received via the tone-generating position adjustment screw. The front extension of the mass member pops up to a level higher than the key when the key is depressed. A front weight and a back weight are arranged separately in the front extension and in the rear extension, respectively. A distance between the pivot-receiving portion and the front weight arranged in the front extension is set to be shorter than the distance between the pivot-receiving portion and the back weight member arranged in the rear extension.

8 Claims, 15 Drawing Sheets

FIG. 8A

| | | | |
|---|---|---|---|
| FRONT WEIGHT W1 | tW1 | TYPE B | gW1 |
| FRONT WEIGHT W2 | tW1 | TYPE A | gW2 |
| FRONT WEIGHT W3 | tW2 | TYPE B | gW3 |
| FRONT WEIGHT W4 | tW2 | TYPE A | gW4 |
| FRONT WEIGHT W5 | tW3 | TYPE A | gW5 |
| FRONT WEIGHT W6 | tW4 | TYPE B | gW6 |
| FRONT WEIGHT W7 | tW4 | TYPE A | gW7 |
| FRONT WEIGHT W8 | tW5 | TYPE A | gW8 |
| NAME | Ft(mm) | SHAPE | WEIGHT(g) |

FIG. 8B

| | | | |
|---|---|---|---|
| FRONT WEIGHT B1 | tB1 | TYPE C | gB1 |
| FRONT WEIGHT B2 | tB2 | TYPE A | gB2 |
| FRONT WEIGHT B3 | tB3 | TYPE B | gB3 |
| FRONT WEIGHT B4 | tB3 | TYPE A | gB4 |
| FRONT WEIGHT B5 | tB4 | TYPE A | gB5 |
| FRONT WEIGHT B6 | tB4 | TYPE A | gB6 |
| FRONT WEIGHT B7 | tB5 | TYPE A | gB7 |
| FRONT WEIGHT B8 | tB6 | TYPE B | gB8 |
| NAME | Ft(mm) | SHAPE | WEIGHT(g) |

FIG. 9A

| | | |
|---|---|---|
| BACK WEIGHT W1 | tW11 | gW11 |
| BACK WEIGHT W2 | tW12 | gW12 |
| BACK WEIGHT W3 | tW13 | gW13 |
| BACK WEIGHT W4 | tW14 | gW14 |
| BACK WEIGHT W5 | tW15 | gW15 |
| BACK WEIGHT W6 | tW16 | gW16 |
| BACK WEIGHT W7 | tW17 | gW17 |
| BACK WEIGHT W8 | tW18 | gW18 |
| NAME | Bt(mm) | WEIGHT(g) |

FIG. 9B

| | | |
|---|---|---|
| BACK WEIGHT B1 | tB11 | gB11 |
| BACK WEIGHT B2 | tB11 | gB11 |
| BACK WEIGHT B3 | tB12 | gB12 |
| BACK WEIGHT B4 | tB13 | gB13 |
| BACK WEIGHT B5 | tB14 | gB14 |
| BACK WEIGHT B6 | tB15 | gB15 |
| BACK WEIGHT B7 | tB16 | gB16 |
| BACK WEIGHT B8 | tB17 | gB17 |
| NAME | Bt(mm) | WEIGHT(g) |

ELECTRIC KEYBOARD ASSEMBLY AND METHOD OF MANUFACTURING WEIGHT MEMBERS PROVIDED IN KEYBOARD ASSEMBLY

BACKGROUND OF THE INVENTION

1. Field of the Invention

This invention relates to an electric keyboard assembly which is provided with mass members each pivotally moved by depression of a corresponding key, and a method of manufacturing weight members provided in such a keyboard assembly.

2. Prior Art

Conventionally, an electronic keyboard assembly is known, in which mass members (hammer members) each having an appropriate mass are driven for pivotal movement by depression of corresponding keys, to thereby provide a simulated key-touch response of an acoustic piano.

For instance, in a keyboard assembly of this kind, seesaw-type mass members each have an arm formed with a follower, and a driving force generated by depression of a corresponding key is transmitted from the key to the follower directly or indirectly via an intermediate member, to cause pivotal movement of the mass member. Further, a proper moment of inertia is applied to each mass member e.g. by the use of a weight member mounted in the same. For instance, similarly to the case of an acoustic piano, the moment of inertia of each mass member is set such that it is progressively increased from a highest pitch key to a lowest-pitch key, for proper adjustment of dynamic key-touch response. Further, each weight member is configured for its associated key by taking a static load of the whole assembly into consideration, or an additional weight member is attached to each key, so as to reduce differences in static key-touch response between the keys to the same level as that in the acoustic piano.

Some electric keyboard assemblies of the above conventional type employ a so-called pop-up structure in which each mass member is designed to allow a free end of its arm to pop up to a position higher than the associated key. In this case, it is required to maintain space particularly above the level of the key. When weight members are provided for respective mass members, they tend to be large in size and arranged at respective free ends of the mass members to efficiently secure the moment of inertia. Further, the weight members are often mounted in a manner slightly projecting vertically from the mass members, so that they reduce space or room above and below the keyboard. Moreover, the arm on which a weight member is provided tends to be increased in length to efficiently obtain the moment of inertia. This causes an increased vertical travel distance of the weight portion of each mass member when the mass member is pivoted, which further reduces the above-mentioned space or room. For these reasons, the conventional keyboard assembly requires increased vertical space and hence tends to have an increased height (thickness).

Further, when the weight member is mounted in the vicinity of the follower which is normally formed in one arm of the mass member, the size of the weight member has to be limited to prevent interference between the weight member and keys adjacent thereto. As a result, the degree of freedom in mass distribution is limited, which hinders proper key scaling to key-touch response.

Moreover, in order to maintain excellent static and dynamic key-touch response and accomplish proper key scaling, it is often required to adjust mass distribution over each mass member and form the mass members in different configurations from each other. Mass distribution over a mass member is required to be set in consideration of not only differences between the keys ranging from the lowest-pitch key to the highest-pitch key but also differences between white keys and black keys. In other words, in spite of differences in construction, each white key and an adjacent black key are required to be substantially identical in key-touch response (reaction force). However, the white key and the black key are different in length from each other. Therefore, even if the respective positions of fulcrums of the white and black keys are set differently, when mass distribution is set for each of mass members corresponding to the respective keys in consideration of both of dynamic and static key-touch response, the mass members slightly differ in configuration from each other. As a result, the number of types of mass members used is increased, which increases the variety of configuration of the mass members, resulting in increased difficulty in mounting of mass members on the body of the keyboard assembly and increased manufacturing costs. Moreover, it is not easy to carry out mass distribution over each mass member. Therefore, in the conventional electric keyboard assembly, uniformity or consistency in construction of the mass members cannot be ensured in carrying out proper key scaling to key-touch response, especially between the low-pitch keys and the high-pitch keys or between the white keys and the black keys. In short, it is difficult to carry out key scaling to key-touch response without complicating the configurations of mass members.

Still further, when a plurality of types of weight members are attached to a mass member for adjustment of mass distribution over the mass member, the conventional electric keyboard assembly has room for improvement in respect of ease of manufacture of other types of weight members and mounting of the same and reduction of manufacturing costs.

SUMMARY OF THE INVENTION

It is a first object of the present invention to provide an electric keyboard assembly which can have a reduced height of a keyboard and at the same time maintain the degree of freedom in designing the keyboard to facilitate key scaling to key-touch responses.

It is a second object of the present invention to provide an electric keyboard assembly which has a uniform key-touch response between each adjacent white and black keys, and allows mass members to have a uniform resin portion, thereby making it possible to simplify the construction of each mass member, facilitate the manufacture and assembly work thereof, and reduce manufacturing costs of the electronic keyboard assembly.

It is a third object of the present invention to provide an electric keyboard assembly having a construction which makes it possible to easily accomplish key scaling to key-touch responses and make mass members as uniform in construction as possible, thereby making it possible to simplify the construction of each mass member, facilitate the manufacture and assembly work thereof, and reduce manufacturing costs of the electronic keyboard assembly.

It is a fourth object of the present invention to provide a method of manufacturing weight members used in keyboard assemblies, which can enable manufacture of the weight members in an efficient manner so as to simplify the construction of mass members with the weight member mounted therein and facilitate assembly work thereof.

The electric keyboard assembly according to the present invention includes not only electronic keyboard assemblies, but also electric keyboard assemblies which are keyboard assemblies for musical instruments in which strings are struck by respective hammers, and the resulting vibrations of the strings are electrically amplified, and acoustic keyboard assemblies.

Weight members manufactured by the method of manufacturing weight members according to the present invention are used by being secured to mass members and/or keys.

To attain the first object, according to a first aspect of the invention, there is provided an electric keyboard assembly comprising a plurality of keys that are each pivotally moved by a key depressing operation, and a plurality of seesaw-type mass members that each have first and second arms extending in opposite directions from a pivotal center of the mass, and a follower arranged on the first arm, the mass members being disposed in a manner associated with the plurality of keys, respectively, and each pivotally moved about the pivotal center by a driving force generated by depression of a corresponding one of the plurality of keys and received via the follower, the first arm of the mass member popping up to a level higher than the corresponding key when the corresponding key is depressed, and a plurality of weight members that are disposed separately in the first arm and in the second arm, respectively, and a distance between the pivotal center and the weight member disposed in the first arm being set to a smaller value than a distance between the pivotal center and the weight member disposed in the second arm.

According to the electric keyboard assembly of the first aspect, when a key is pivotally moved by a key depressing operation, a mass member associated with the key is pivotally moved about its pivotal center by the driving force generated by the key depressing operation and received via the follower arranged in the first arm, and the first arm of the mass member pops up to a level higher than the key.

However, the weight members are separately disposed in the first arm and in the second arm, respectively, so that it is possible to make the sizes of the two weight members smaller than when a weight member is disposed only in one of the two arms, which contributes to saving of space within the keyboard in a direction of height.

Further, since the distance between the pivotal center and the weight member disposed in the first arm is shorter than the distance between the pivotal center and the weight member disposed in the second arm, it is possible to reduce the vertical travel distance of the first arm (e.g. a free end portion thereof). Thus, a pop-up level which the end of the first arm reaches is limited to a relatively low level, which makes it possible to reduce the vertical space within the keyboard assembly.

Moreover, since the two distances from the pivotal center are not equal to each other, and the weight members are separately disposed as above, it is possible to obtain an adequate moment of inertia by using weight members lighter in weight, which makes it possible to use weight members having a reduced size. As a result, interference between the mass member and the weight members and adjacent keys can be readily prevented from occurring in the vicinity of the abutment portion between the follower and the driving portion of the corresponding key or an intermediate portion interposed between these portions, whereby the degree of freedom in designing the mass member is ensured. Thus, mass distribution can be easily adjusted, which facilitates key scaling to key-touch response.

To attain the second object, according to a second aspect of the invention, there is provided an electric keyboard assembly comprising a plurality of white keys that are each pivotally moved by a key depressing operation, a plurality of black keys that are each pivotally moved by a key depressing operation, a plurality of seesaw-type mass members that each have a first arm and a second arm each extending from a pivotal center of the mass member, the plurality of mass members being disposed in a manner associated with the plurality of white keys and black keys, respectively, and being each pivotally moved about the pivotal center when a corresponding one of the plurality of white keys or black keys is depressed, the plurality of mass members each having a resin portion, the resin portion of one of the mass members associated with one of the white keys being substantially identical in configuration with the resin portion of another of the mass members associated with one of the black keys which is adjacent to the one of the white keys, and a plurality of insert weight members that are arranged respectively in the first and second arms of each of the mass members, and the insert weight members having respective weights thereof set separately from each other, whereby key-touch responses of the one of the white keys and the one of the black keys adjacent thereto are made similar to each other.

According to the electric keyboard assembly of the second aspect, the insert weight members respectively arranged in the first and second arms of each of the mass members have weights thereof set separately from each other, whereby the key-touch response of one of the white keys and that of the black keys adjacent thereto are made similar to each other, thereby allowing all the keys to provide key-touch response with increased uniformity. Further, the resin portion of one of the mass members associated with one of the white keys are substantially identical in configuration with the resin portion of another of the mass members associated with one of the black keys which is adjacent to the one of the white keys. This enables the adjacent white and black keys to provide uniform key-touch response, and makes it possible to simplify the configuration of each mass member, facilitate the manufacture and assembly work thereof, and reduce manufacturing costs of the electronic keyboard assembly, through the uniform configuration of the resin portions of the mass members.

To attain the third object, according to a third aspect of the invention, there is provided an electric keyboard assembly comprising a plurality of keys that are each pivotally moved by a key depressing operation, a plurality of mass members that each have a body, and are disposed in a manner associated with the plurality of keys, respectively, the plurality of mass members being each pivotally moved about a pivotal center thereof when a corresponding one of the plurality of keys is depressed, the body of each of the plurality of mass members being formed of resin and having at least one hollow weight-mounting portion formed therein, and at least one weight member that is mounted in the at least one hollow weight-mounting portion, the at least one weight member each having a hollow portion formed therein, and the hollow portion of the at least one weight member of each of the plurality of mass members having a volumetric capacity thereof set separately from each other so as to accomplish key scaling to key-touch response.

According to the electric keyboard assembly of the third aspect, the body of each of the plurality of mass members is formed of resin, and a weight member is mounted in the hollow weight-mounting portion formed in the body of each of the plurality of mass members. This permits the resin-made bodies of the respective mass members to be made identical or uniform in configuration except for the weight members. Further, each weight member is formed with a hollow portion, and the volumetric capacity of the hollow portion of each weight member to be mounted in a corresponding one of the plurality of mass members is set individually (including the case where no hollow portion is provided) for accomplishment of key scaling to key-touch response. This makes it possible to change the weight of each weight member as desired by changing the shape of the hollow portion e.g. in the form of a hole, a recess or the like, without affecting the configuration of the resin-made body of the mass member. Thus, mass distribution over each mass member can be set as desired by setting the volumetric capacity of the hollow portion, so that it is possible to accomplish key scaling to key-touch response with ease and at the same time, make the mass members uniform in configuration.

To attain the third object, according to a fourth aspect of the invention, there is provided an electric keyboard assembly comprising a plurality of keys that are each pivotally moved by a key depressing operation, a plurality of seesaw-type mass members that each have a body, and first and second arms extending in opposite directions from a pivotal center thereof, the plurality of mass members being disposed in a manner associated with the plurality of keys, respectively, the plurality of mass members being each pivotally moved about the pivotal center when a corresponding one of the plurality of keys is depressed, the body of each of the plurality of mass members being formed of resin, the body including a follower for receiving a driving force generated by the key depressing operation, a stopper abutment portion for abutment with a stopper for setting a pivotal movement-completing position of the mass member, and a sensor depressing portion for depressing a sensor for detecting the key depressing operation, each of the plurality of mass members having first and second weight-mounting portions formed in the first and second arms, respectively, and first and second insert weight members that are mounted in the first and second weight-mounting portions, respectively, the follower, the stopper abutment portion, and the sensor depressing portion each having an identical configuration between ones of the plurality of mass members for a plurality of octave sections. A plurality of combinations of weights of the first and second insert weight members to be mounted in the first and second arms, respectively, can be set between the ones of the plurality of mass members for the plurality of octave sections, while maintaining ease of operation of mounting the first and second insert weight members in a corresponding one of the plurality of mass members.

According to the electric keyboard assembly of the fourth aspect, the follower, the stopper abutment portion and the sensor depressing portion of each of the plurality of mass members each have a construction substantially uniform between mass members for a plurality of octave sections. This makes it possible to make uniform at least essential component parts of the mass members for the octave sections. Further, a plurality of combinations of weights of the two insert weight members to be mounted in the two weight-mounting portions, respectively, can be set between the mass members for a plurality of octave sections. This makes it possible to set a plurality of kinds of key-touch responses by changing the combination, to thereby vary e.g. the dynamic key-touch response between keys. In this case, the key-touch response can be set only by changing the combination of weights, which facilitates key scaling. Further, the combination of weights of the two insert weight members is set while maintaining ease of operation for mounting each of the insert weight members in a corresponding one of the plurality of mass members. This makes it possible to make the weight-receiving portions of the respective mass members identical or uniform in construction, whereby the weight-receiving portions can be made uniform for the plurality of octave sections.

Preferably, the first and second insert weight members each have an outer periphery and are formed of a sheet member, the outer periphery being configured such that it can be fitted in a corresponding one of the first and second weight-mounting portions of each of the plurality of mass members, and the plurality of combinations of weights of the first and second insert weight members to be mounted in the first and second arms, respectively, can be set by at least one of changing weights of the first and second insert weight members and changing thickness of the first and second insert weight members, while maintaining the outer periphery identical in configuration between the first and second insert weight members.

According to this preferred embodiment, the insert weight members are each formed of a sheet member, and the outer periphery of each inserted weight member is fitted in the weight-mounting portion of the mass member. Further, the combination of weights of the two insert weight members provided in the first and second arms of the mass member, respectively, is set by at least one of changing weights of the first and second insert weight members and changing thickness of the first and second insert weight members, while maintaining the outer periphery identical in configuration between the first and second insert weight members, so that the combination of weights of the insert weight members can be set as desired, which enables desired key scaling to effected over the plurality of octave sections with ease. In addition, since the outer periphery of each inserted weight is generally uniform in shape, fittability of the weight in the weight-receiving portion is maintained, which prevents the configuration of the mass member from becoming complicated.

To attain the third object, according to a fifth aspect of the invention, there is provided an electric keyboard assembly comprising a plurality of pivotally movable members that each have a pivotally movable member body and are each pivotally moved by a key depressing operation, and a plurality of weight members each having an outer periphery and mounted in the plurality of pivotally movable members, the weight members mounted in the plurality of pivotally movable members being different in weight from each other so as to vary key-touch response between the keys or between groups of the keys during key depression, thereby accomplishing key scaling to key-touch response, at least one of the weight members being formed of a plurality of weight component parts laminated one upon another and fixed together, the plurality of weight component parts having a substantially identical outer shape in plan view, the pivotally movable members being formed by outsert molding, the outer periphery of each of the weight members being covered by resin outserted thereon, the pivotally movable member body comprising an outserted portion covering the outer periphery of each of the weight members, the weight members mounted in the pivotally movable members being different in weight between the keys or between key ranges.

According to the keyboard assembly of the fifth aspect, at least one of the weight members is formed of a plurality of weight component parts laminated one upon another and fixed together, and the plurality of weight component parts have a substantially uniform outer shape in plane view. This makes it unnecessary to fix the weight component parts to each other by screws or the like, which facilitates manufacture of weigh members having different weights. Further, the pivotally movable members are each formed by outsert molding, the outer periphery of each of the weight members is covered by resin outserted thereon, the pivotally movable member body comprises an outserted portion covering the outer periphery of the each of the weight members, and the weight members are mounted in the pivotally movable members, respectively, and are different in weight between keys or between key ranges. This makes it easy to manufacture pivotally movable members different in inertial mass, and hence key scaling to key-touch response can be facilitated.

To attain the fourth object, according to a sixth aspect of the invention, there is provided a method of manufacturing a weight member mounted in a pivotally movable member provided in a keyboard assembly, said weight member comprising a plurality of weight component parts laminated one upon another, the method comprising the steps of intermittently moving a sheet member formed of a metal, and forming half-puched portions each having a projection on one side surface of the sheet member and a recess on an opposite side surface thereof, during stoppage of intermittent movement of the sheet member, punching, using a cavity blade, a portion of the sheet member along an outer periphery thereof which is located radially outward of the half-punched portions to form each of the weight component parts having the half-punched portions, and sequentially laminating the formed weight component parts one upon another within said cavity blade such that the recesses or projections of the half-punched portions of an leading one of the weight component parts are fitted with the projections or recesses of the half-punched portions of a following one of the weight component parts, and removing the weight member formed of a predetermined number of the weight component parts laminated one upon another from the cavity blade when the predetermined number of the weight component parts are laminated one upon another.

According to the method of manufacturing a weight member of the sixth aspect, a sheet member formed of a metal is intermittently moved, and half-puched portions, each having a projection on one side surface of the sheet member and a recess on an opposite side surface thereof, are formed during stoppage of intermittent movement of the sheet member, a portion of the sheet member is punched, using a cavity blade, along an outer periphery thereof which is located radially outward of the half-punched portions to form each of the weight component parts having the half-punched portions, the formed weight component parts are sequentially laminated one upon another within said cavity blade such that the recesses or projections of the half-punched portions of an leading one of the weight component parts are fitted with the projections or recesses of the half-punched portions of a following one of the weight component parts, and the weight member formed of a predetermined number of the weight component parts laminated one upon another is removed from the cavity blade when the predetermined number of the weight component parts are laminated one upon another. Therefore, the weight members can be manufactured in an efficient manner, which makes it possible to simplify the construction of mass members with the weight member mounted therein and facilitate assembly work thereof.

Preferably, the plurality of weight component parts have a substantially identical outer shape in plan view.

The above and other objects of the invention will become more apparent from the following detailed description taken in conjunction with the accompanying drawings.

BRIEF DESCRIPTION OF THE DRAWINGS

FIG. 8A is a view showing an example of a table of combinations of thicknesses Ft and shapes of the white-key front weight FRW;

FIG. 8B is a view showing an example of a table of combinations of settings of thickness Ft and shapes of the black-key front weight FRW;

FIG. 9A is a view showing an example of a table of settings of thickness Bt for the white-key back weights BUW;

FIG. 9B is a view showing an example of a table of thickness Bt for respective black-key back weights BUW;

DETAILED DESCRIPTION OF PREFERRED EMBODIMENTS

The present invention will now be described in detail with reference to drawings showing a preferred embodiment thereof.

Figure 1:
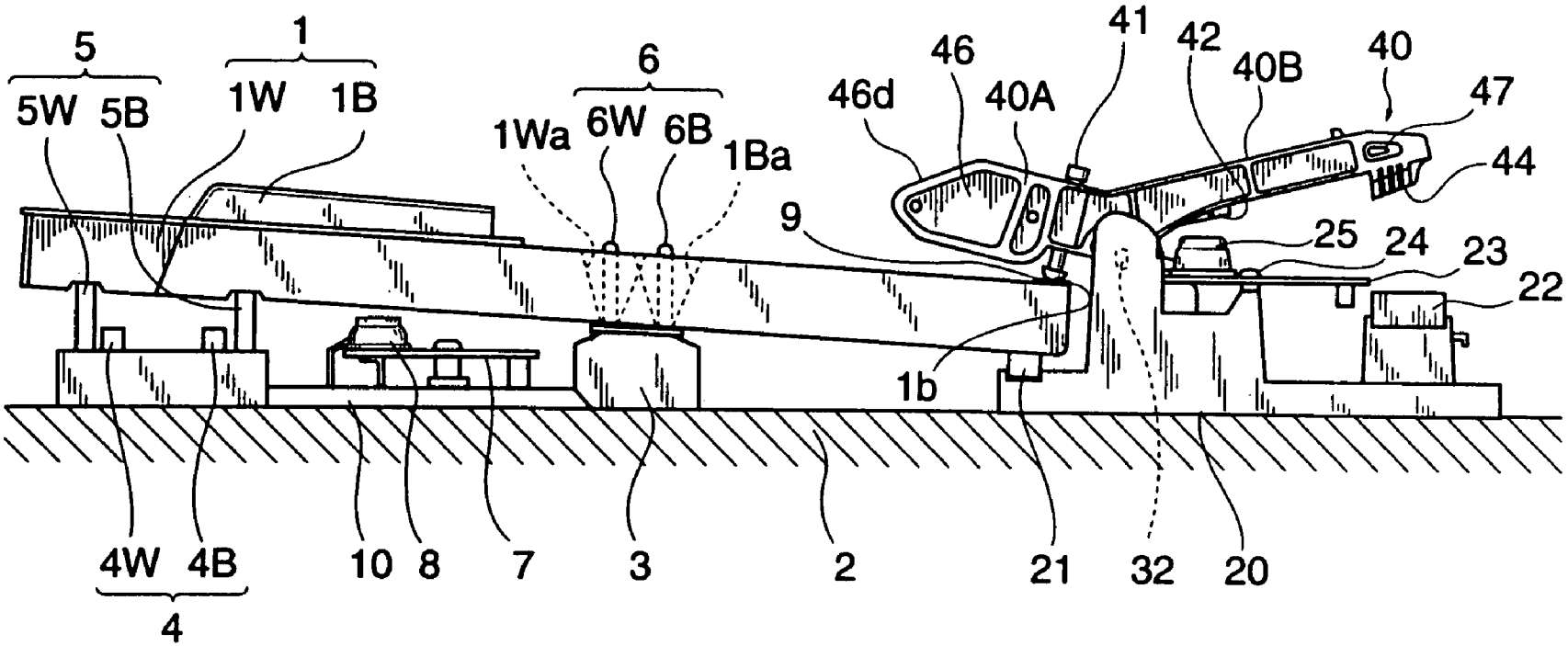
FIG. 1 is a longitudinal cross-sectional view of essential parts of an electronic keyboard assembly which is embodied as an electric keyboard assembly according to an embodiment of the invention, in a non-key-depression state.
Figure 2:
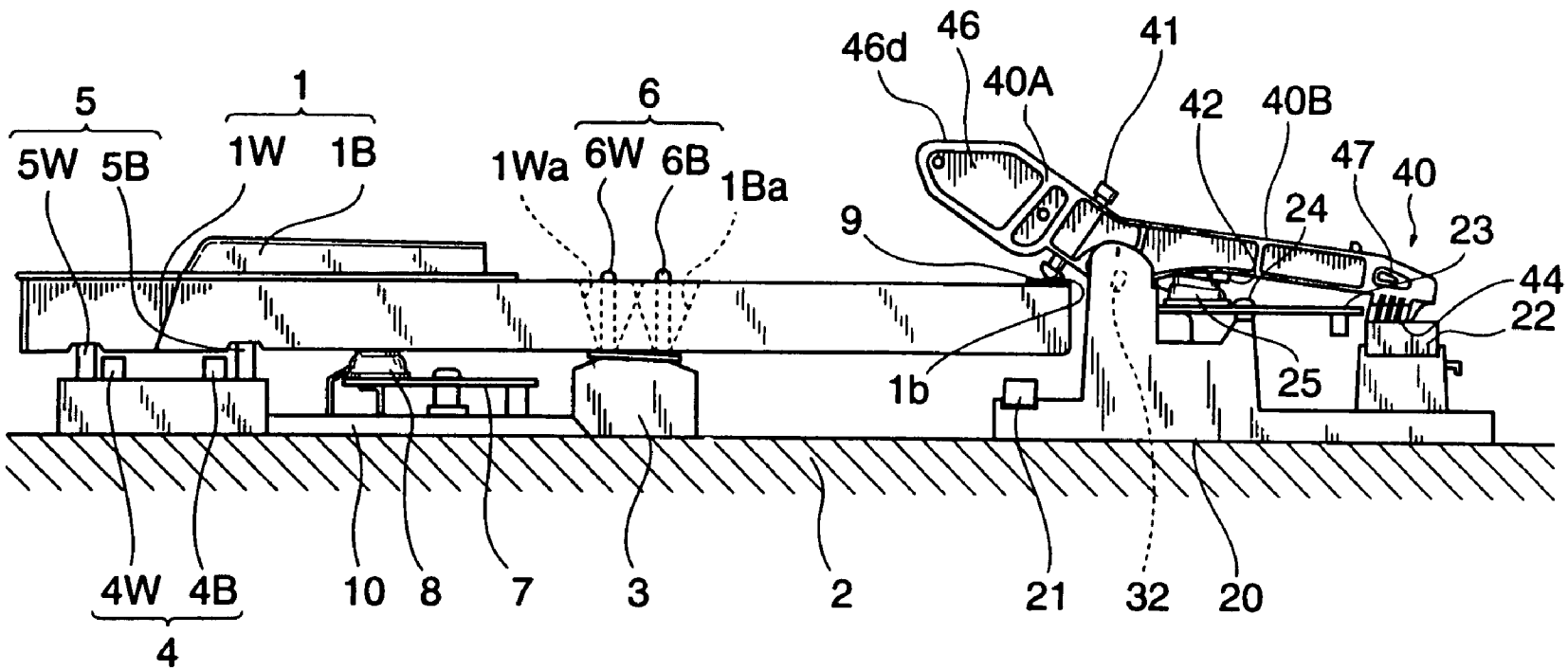
FIG. 2 is a longitudinal cross-sectional view of the essential parts of the electronic keyboard assembly in a full-key-depression state.

FIGS. 1 and 2 are cross-sectional views of essential parts of an electronic keyboard assembly as an electric keyboard assembly according to an embodiment of the present invention, in which FIG. 1 shows a non-key-depression state (i.e. a state where each of a key 1 and a mass member 40, referred to hereinafter, is in its pivotal movement-starting position), and FIG. 2 shows a full-key-depression state (i.e. a state where each of the key 1 and the mass member 40 is in its pivotal movement-completing position). An upper casing and a lid are omitted in the figures. In the following, a player side (left side, as viewed in FIG. 1) of the keyboard assembly will be referred to as "front" or "forward", while a remote side (right side, as viewed in FIG. 1) of the same from the player will be referred to as "rear" or "rearward".

The keyboard assembly is comprised of a plurality of seesaw-type keys 1 (white keys 1W and black keys 1B) for depression, mass member support members 20, and a plurality of mass members (pivotally movable members) 40 pivotally supported by the mass member support members 20 and each driven for pivotal movement by depression of a corresponding one of the keys 1.

A key frame 10 is mounted on a shelf board 2. Formed on the key frame 10 is a key support portion 3 having a plurality of fulcrum pins 6 (white-key fulcrum pins 6W and black-key fulcrum pins 6B) extending upright therefrom in a manner associated with the respective keys 1. Each key 1W or 1B is formed with a fulcrum hole 1W*a* or 1B*a*. The fulcrum holes 1W*a*, 1B*a* are each in the form of a truncated cone which decreases in inner diameter toward a lower end thereof. In mounting of each key 1 on a body (i.e. the key frame 10) of the keyboard assembly, the fulcrum pin 6 is fitted through the fulcrum hole 1W*a* or 1B*a*, whereby the position of the key 1 is limited in the directions of width and length thereof, and at the same time the key 1 is supported by the key support portion 3 in a manner pivotally movable in the direction of key depression. The key 1 has urethane foam affixed to a top of a rear end portion thereof with a smooth tape applied on the urethane form, for excellent sliding contact thereon. The portion labeled with the elastic member formed by the urethane foam and tape servers as a driving portion 9 which is brought into contact with a tone-generating position adjustment screw (follower) 41, referred to hereinafter, of the mass member 40 for driving the mass member 40. The elastic member enables smooth contact between the key 1 and the mass member 40 without chattering.

A key stopper 4 (white-key stopper 4W and black-key stopper 4B) and a key guide 5 (white-key guide 5W and black-key guide 5B) are arranged on the front portion of the key frame 10 in a manner associated with the corresponding key 1. The key stopper 4 abuts the corresponding key 1 to limit or set the pivotal movement-completing position (FIG. 2B) when the key 3 is depressed. The key guide 5 prevents a corresponding key 1 from wobbling in the direction of width when the key 1 is pivotally moved.

Further, mounted on the key frame 10 is a switch board 7 at a location rearward of the key stopper 4 and the key guide 5 and forward of the key support portion 3. On the switch board 7, there are mounted first switches 8 in a manner associated with the respective keys 1, basically for detecting key operation.

The mass member support members 20 are arranged in the vicinity of the rear ends of the respective keys 1 on the shelf board 2. Each support member 20 is provided for a corresponding one octave section of the keyboard, for example, and secured on the shelf board 2, with front and rear portions thereof fixed at suitable points thereof to the shelf board 2. The front portion of each support member 20 is provided with stoppers 21 arranged in a manner associated the respective keys 1 of the corresponding octave section, for operating in a non-key-depression state. The abutment of a key 1 on a corresponding stopper 21 sets the pivotal movement-starting position (FIG. 1) of the key 1 from which the key 1 starts to be pivoted when the key 1 is depressed, i.e. the position of non-depression state of the key 1. On the rear portion of the support member 20, there is formed a mass-member stopper 22, referred to hereinafter, having elasticity. When an abutment portion (stopper abutment portion) 44, referred to hereinafter, of the mass member 40 abuts the stopper 22, the stopper 22 sets the pivotal movement-completing position (FIG. 2) to which the mass member 40 is moved by key depression. The stopper 22 also serves as a damper.

Further, a switch board 23 is mounted on a plurality of support members 20 e.g. for all the keys 1 of the keyboard, and fixed to the support members 20 by screws 24. Mounted on the switch board 23 are second key switches 25 which cooperate with the respective mass members 40. The second key switches 25 are each pressed downward by a corresponding mass member 40, basically for indirectly detecting key release operation of a corresponding key 1. Although in the present embodiment, it is possible to perform various musical tone control processes in response to results of detection by both the first key switches 8 and the second key switches 25 by using predetermined algorithms in respective predetermined modes, this is not limitative but musical tone control may be carried out in response to results of detection by one of the switch groups.

Each support member 20 is also formed with pivot portions 32. Each of the pivot portions 32 pivotally supports a corresponding one of the mass members 40 by engagement with a pivot-receiving portion (pivotal center) 45, referred to hereinafter, of the mass member 40.

In the keyboard assembly of the present embodiment, a so-called pop-up structure is employed, and therefore each mass member 40 pops upward of a corresponding key 1. When the mass member 40 is in its pivotal movement-starting position, a tail portion 47 thereof is at a higher level than any other portion of the mass member 40, while when the mass member 40 is in its pivotal movement-completing position, a top surface 46*d* of a head portion 46 thereof is at a highest level. However, during the whole stroke of depression, the level of the top surface 46*d* of the head portion 46 in the pivotal movement-completing position of the mass member 40 is highest, so that the height (vertical thickness) of the keyboard assembly is set basically by taking the highest level of the forward upper side face 46*d* into consideration.

Figure 3:
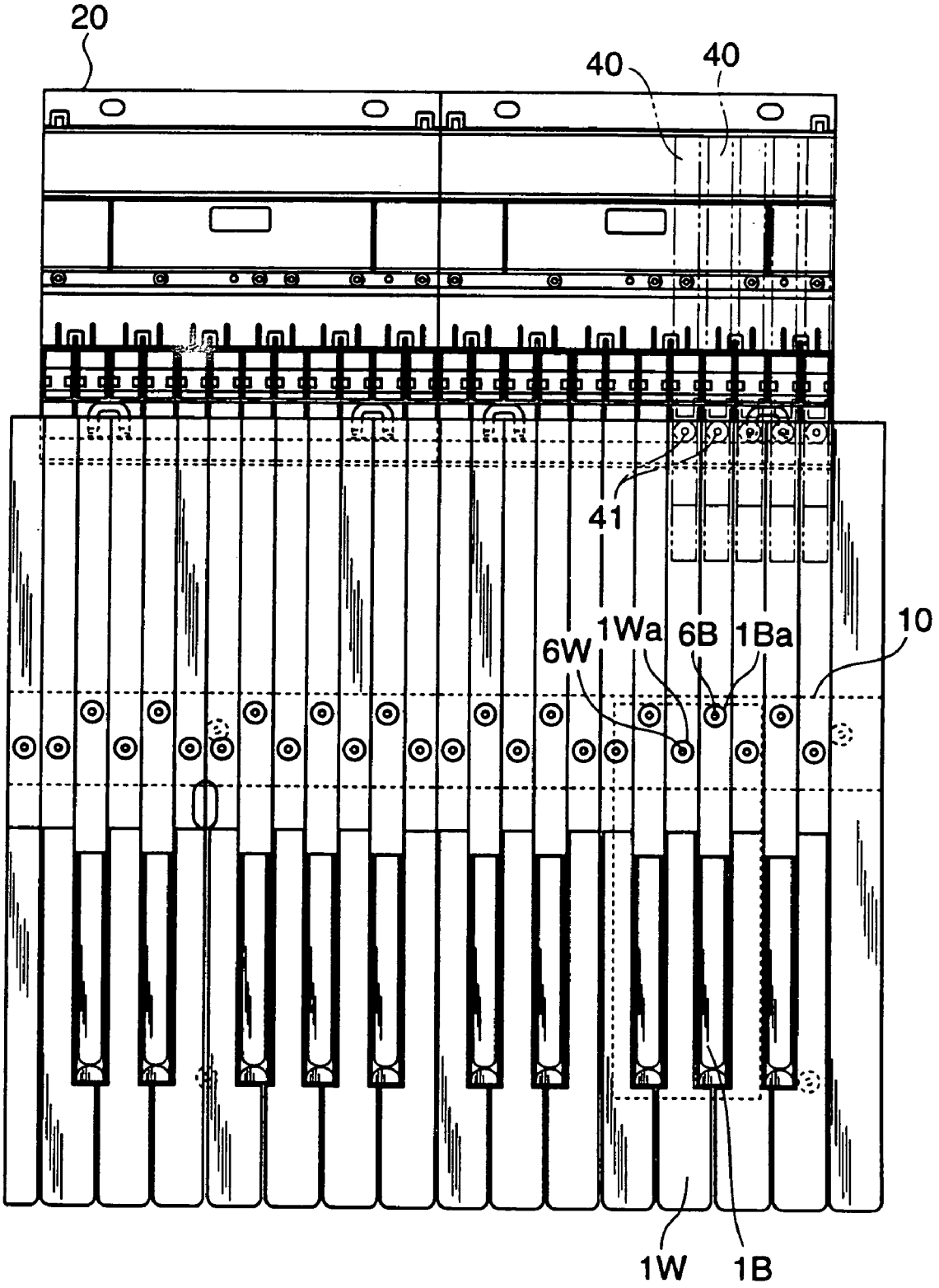
FIG. 3 is a top plan view of the electronic keyboard assembly, as viewed from above.

FIG. 3 is a top plan view of essential parts of the electronic keyboard assembly, as viewed from above. In the figure, substantially two octave sections of the assembly and some of the mass members 40 are partly shown, but the upper casing, the lid, and so forth are omitted. The mass members 40 are provided in a manner associated with each of the white keys 1W and the black keys 1B.

Figure 4:
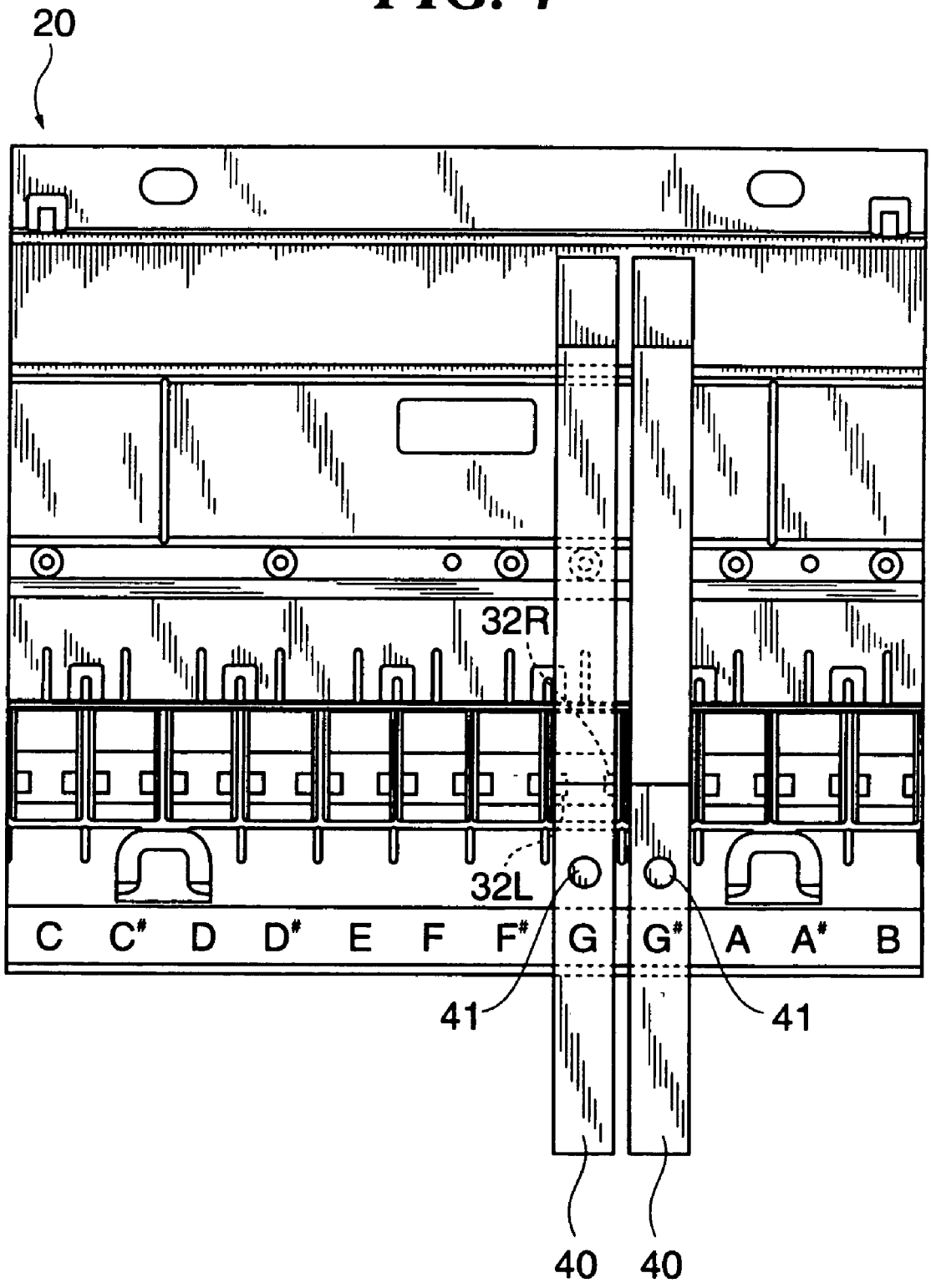
FIG. 4 is a top plan view of a support member, as viewed from above.

FIG. 4 is a top plan view of the support member 20, as viewed from above. In the figure, only two mass members 40 corresponding to a G key and a G# key are shown, but the switch board 23 is omitted. As shown in the figure, the pivot portions 32 of the support member 20 are each formed by a left projection 32L and a right projection 32R and arranged in a manner corresponding to each mass member 40.

Figure 5:
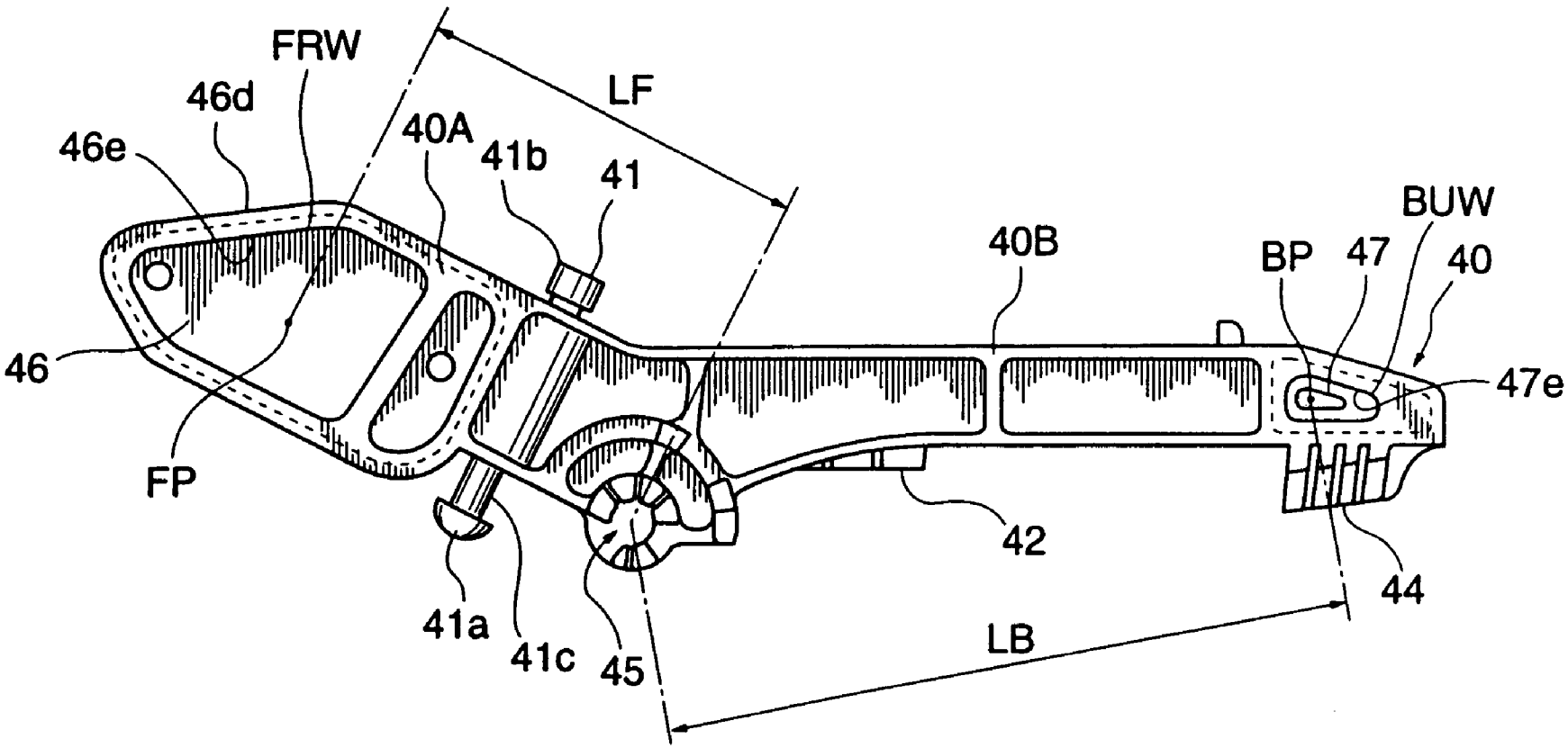
FIG. 5 is a side view showing the construction of a mass member.

FIG. 5 is a side view of the construction of the mass member 40.

Each mass member 40 is provided for ensuring an adequate key-touch response. All the mass members 40 are configured similarly, and a portion (pivotally movable member body) of the mass member 40 other than the tone-generating position adjustment screw 41, a front weight (weight member) FRW and a back weight (weight member) BUW is formed of resin. The mass member 40 has opposite side surfaces thereof each formed with the pivot-receiving portion 45 having formed therein a hole in the form of an opened circle in cross-section. The mass member 40 is pivotally supported by the support member 20 through engagement between the pivot-receiving portions 45 and the respective left and right projections 32L, 32R of a corresponding one of the pivot portions 32 of the support member 20. When a corresponding key is depressed or released, the pivot-receiving portions 45 are pivotally moved about the pivot portion 32 secured to the support member 20, whereby the mass member 40 is pivotally displaced.

The mass member 40 is comprised of a front extension (first arm) 40A extending forward from a central portion including the pivot-receiving portions 45, and a rear extension (second arm) 40B extending rearward from the central portion. The head portion 46 of the front extension 40A and the tail portion 47 of the rear extension 40B are formed with hollow weight-mounting portions 46*e*, 47*e*, respectively, for mounting weight members as mass for securing an adequate inertial force during key depression. The front weight FRW and the back weight BUW are separately inserted in the respective weight-mounting portions 46*e* and 47*e*.

The weights FRW, BUW are mounted in the mass member 40 by outserting resin on the metal weights FRW, BUW during a process of forming the mass member 40 by a mold, thereby forming the weight members as inserts in the mass member 40. Alternatively, the mass member 40 and the weights FRW, BUW may be formed separately. In this case, a soft resin is outserted on outer peripheries (plane outer shapes) FRWe and BUWe (see FIGS. 6A to 6D and FIGS. 7A, 7B) of the weights FRW, BUW, and then the weights FRW, BUW are press-fitted in inner peripheries of the respective weight-mounting portions 46*e*, 47*e*, thereby completing the mass member 40. How the weights of the weights FRW, BUW is set will be described in detail hereinafter.

The distance between a center of gravity FP of the front weight FRW and the center of the pivot-receiving portions 45 is represented as LF, and the distance between a center of gravity BP of the back weight BUW and the center of the pivot-receiving portions 45 as LB.

Each mass member 40 with the weights FRW, BUW inserted therein is configured such that the front extension 40A overweighs the rear extension 40B. Therefore, the mass member 40 is constantly held in contact with the driving portion 9 of the key 1 in the non-key-depression state or at an initial stage of key depression, so that the key 1 and the mass member 40 can be operated in an interlocked manner. It should be noted that depending on the manner of key depression, the mass member 40 is released from the driving portion 9 of the key 1 during a key depression stroke, i.e. before the key 1 is fully depressed.

The tone-generating position adjustment screw 41 is provided in the extending portion 40A. The screw 41 is comprised of a screw head 41*a* having a curved surface, an adjusting portion 41*b* formed with a hexagonal socket, not shown, for receiving a hexagonal wrench, and a screw shaft 41*c* having a threaded portion, not shown, all in one piece. The screw 41 is mounted in the mass member 40 by insert molding when the mass member 40 is formed by a mold, for example. When the key 1 is depressed, the driving portion 9 of the key 1 is brought into contact with the screw head 41*a* of the screw 41 to transmit a driving force generated by the key depression to the mass member 40, whereby the mass member 40 is pivotally moved. When the mass member 40 is formed, the tone-generating position adjustment screw 41 is inserted in the mass member 40 in a state protruding downward to its lowest position. After the formation of the mass member 40, the screw 41 can be screwed by a screwdriver for adjustment of the amount of downward projection from the mass member 40. Thus, the relationship between the amount of the pivotal motion of the mass member 40 and tone generation timing responsive to detection of a key depression by a corresponding key switch 25 can be adjusted.

Mounted on a lower side surface of the rear extension 40B is an actuator (sensor depressing portion) 42 for depressing a corresponding key switch 25 of the support member 20 as the mass member 40 is pivotally moved. The abutment portion 44 is formed on the lower side surface of the rear end portion of the rear extension 40B. When the mass member 40 is pivotally moved by key depression, the abutment portion 44 is brought into contact with the mass-member stopper 22 of the support member 20.

Figure 6A:
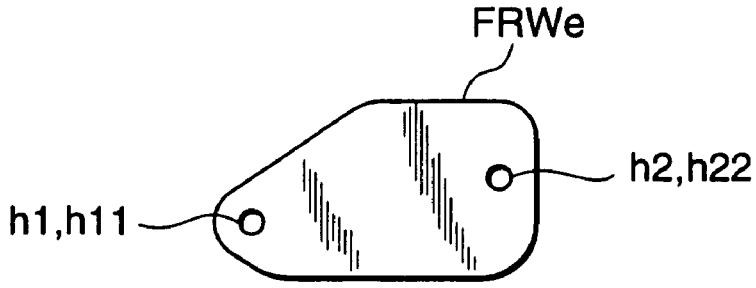
FIG. 6A is a side view of a front weight FRW.
Figure 6B:
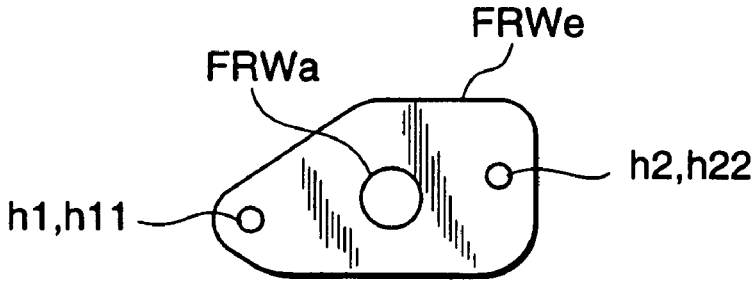
FIG. 6B is a side view of another type of front weight FRW.
Figure 6C:
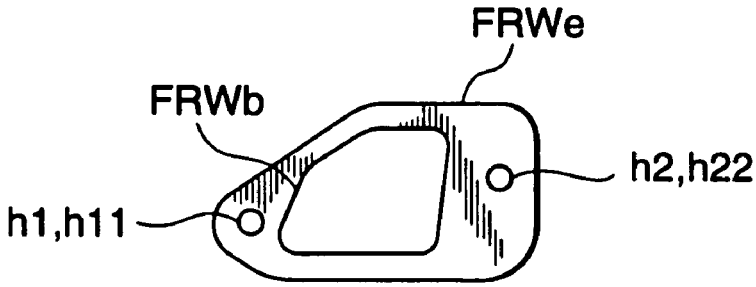
FIG. 6C is a side view of still another type of front weight FRW.
Figure 6D:
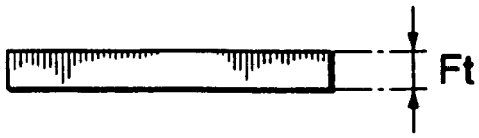
FIG. 6D is a bottom view of the front weights FRW shown in FIGS. 6A to 6C.
Figure 7A:
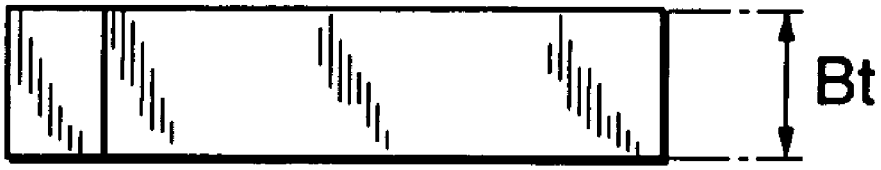
FIG. 7A is a bottom view of a back weight BUW.
Figure 7B:
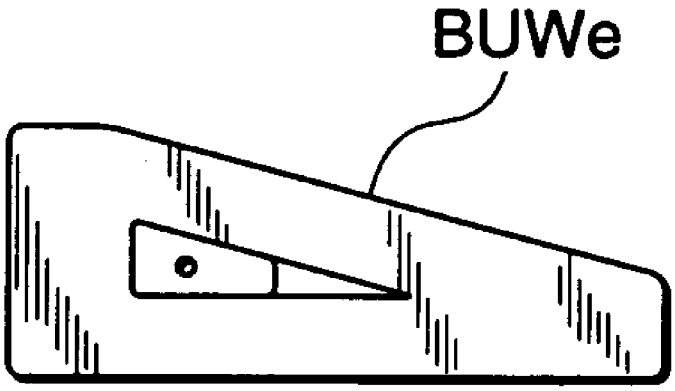
FIG. 7B is a side view of the back weight BUW.

FIGS. 6A to 6C are side views showing different types of front weights FRW, and FIG. 6D is a bottom view which shows that the front weights FRW have lower side surfaces uniform in shape and configuration. FIGS. 7A and 7B show the back weight BUW in bottom view and in side view, respectively.

As shown in FIGS. 6D and 7A, the front weight FRW of each type and the back weight BUW are in the form of sheet members having respective thicknesses Ft and Bt. The weights FRW, BUW are each formed of a metal, such as iron. As shown in FIGS. 6A to 6C, the front weights FRW are classified into three types, i.e. a type having no central through hole (shown in FIG. 6A and hereinafter referred to as "type A"), a type having a small hole FRWa (shown in FIG. 6B and hereinafter referred to as "type B"), and a type having a hole FRWb larger than the hole FRWa (shown in FIG. 6C and hereinafter referred to as "type C"). The types A, B and C have a substantially identical outer shape FRWe and an identical position of the center of gravity FP. On the other hand, there is only one type for the back weight BUW as far as its outer shape and hole are concerned, as shown in FIG. 7B.

The thicknesses Ft, Bt of the front and back weights FRW, BUW are each set by the number of laminated pieces formed by stamping an iron sheet. That is, the thinnest ones FRW, BUW are formed of a single stamped piece, and the thickness Ft or Bt is increased with an increase in the number of laminated pieces. A method of manufacturing the front weights FRW and the back weight BUW will be described in detail hereinafter (see FIGS. 12 to 17A, 17B).

FIGS. 8A, 8B show examples of combinations of settings of thickness Ft and shapes of the front weight FRW. There are eight kinds (W1 to W8) of the front weight FRW provided for the white keys 1A, as shown in FIG. 8A, and eight kinds (B1 to B8) of the same for the black keys 1B, as shown in FIG. 8B.

For example, as shown in FIG. 8A, the thickness Ft of the front weight FRW for the kinds W1 to W8 for the white keys 1W is set to tW1, tW1, tW2, tW2, tW3, tW4, tW4 and tW5, such that the thickness of the weight FRW is sequentially increased e.g. by 0.5 mm from the kind W1 to the kind W8. Further, the type of the front weight FRW for the kinds W1 to W8 is set to type A or type B shown in FIGS. 6A, 6B, that is, the types of the kinds W1 to W8 are set in the order of type B, type A, type B, type A, type A, type B, type A, and type A. As a result, the weights of the kinds W1 to W8 are set, respectively, to gW1, gW2, gW3, gW4, gW5, gW6, gW7, and gW8 such that the weight of the weight FRW is sequentially increased e.g. by several grams from the kind W1 to the kind W8.

On the other hand, as shown in FIG. 8B, the thickness Ft of the front weight FRW for the kinds B1 to B8 for the black keys 1B is set e.g. to tB1, tB2, tB3, tB3, tB4, tB4, tB5, and tB6, respectively. Further, the type of the front weights FRW for the kinds B1 to B8 is set to type A, type B or type C shown in FIGS. 6A to 6C in the order of type C, type A, type B, type A, type A, type A, type A and type B. As a result, the weights of the kinds B1 to B8 are set, respectively, to gB1, gB2, gB3, gB4, gB5, gB6, gB7, and gB8. Of all the kinds of front weights FRW (B1 to B8), the weight FRW (B2) is the lightest, and the weight FRW (B8) is the heaviest.

FIGS. 9A, 9B exemplify how the thickness Bt of the back weight BUW is set. There are eight kinds (W1 to W8) of the back weight BUW provided for the white keys 1W as shown in FIG. 9A, and eight kinds (B1 to B8) of the same provided for the black keys 1B, as shown in FIG. 9B.

For example, as shown in FIG. 9A, the thickness Bt of the back weight BUW for the kinds W1 to W8 for the white keys 1W is set to tW11, tW12, tW13, tW14, tWI5, tW16, tW17, and tW18, respectively, such that the thickness of the weight BUW is sequentially increased e.g. by 1.0 mm from the kind W1 to the kind W8. As a result, the weights of the kinds W1 to W8 are set, respectively, to gW11, gW12, gW13, gW14, gWl5, gW16, gW17, and gW18 such that the weight of the weight BUW is sequentially increased e.g. by several milligrams to several grams from the kind W1 to the kind W8.

On the other hand, as shown in FIG. 9B, the thickness Ft of the back weight BUW for the kinds B1 to B8 for the black keys 1B is set to tB11, tB11, tB12, tB13, tB14, tB15, tB16, and tB17, respectively, such that the thickness of the weight BUW is sequentially increased e.g. by 0 to 1.0 mm from the kind B1 to the kind B8. As a result, the weights of the kinds B1 to B8 are set, respectively, to gB11, gB11, gB12, gB13, gB14, gB15, gB16, and gB7 such that the weight of the weight BUW is sequentially increased e.g. by several grams from the kind B1 to the kind B8.

As described above, the front weight FRW for the white keys 1W and the front weight FRW for the black keys 1B as well as the back weight BUW for the white keys 1W and the back weight BUW for the black keys 1B can be each set to any one of eight different weight values, and therefore, logically, any one of 8×8=64 patterns of combination of the front weight FRW and the back weight BUW can be employed for each mass member 40. In the present embodiment, since an appropriate combination of weights FRW, BUW is selected for each key in view of a dynamic key-touch response as well as a static one, the mass members 40 have different mass distributions.

For instance, the moment of inertia of the mass member 40 is set such that a lower-pitch key has a larger moment of inertia. To achieve this setting, it is only required to set the total weight of a front weight FRW and a back weight BUW for a lower-pitch key to a larger value. This enables each key to provide a dynamic key-touch response closer to that of an acoustic piano.

Further, when the dynamic key-touch response is adjusted as described above, it is also required to consider a static key-touch response of each key, i.e. a reaction force applied to the key when the key is depressed very slowly (i.e. during weak touch). For instance, the reaction force applied to the key is set such that the difference between the reaction force applied to the highest-pitch key during week touch and that applied to the lowest-pitch key during the week touch is limited within a range of several grams. Thus, each key can provide a static key-touch response closer to that of an acoustic piano.

The dynamic key-touch response and the static key-touch response are difficult to adjust separately. Therefore, each weight FRW, BUW is set with the two kinds of key-touch response being taken into consideration at the same time, such that the two kinds of key-touch responses are optimized, whereby keyboard scaling to key-touch response can be accomplished. In this connection, a white key 1W and a black key 1B adjacent thereto provide key-touch responses similar to each other.

According to the present embodiment, since each mass member 40 has a front weight FRW and a back weight BUW separately arranged in the head portion 46 and the tail portion 47, respectively, it is possible to reduce the sizes of the weight members while obtaining the same moment of inertia as in a case where a weight is provided in only one of the head portion 46 and the tail portion 47, as described below with reference to FIGS. 10A, 10B.

Figure 10A:
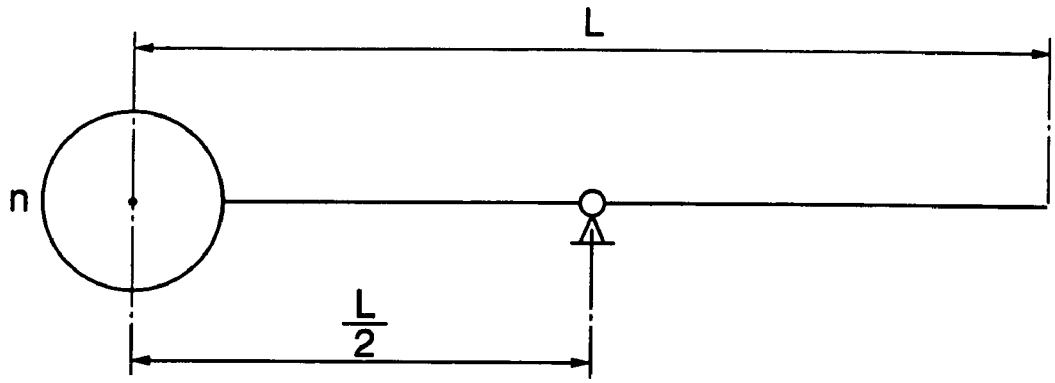
FIG. 10A shows the relationship between the arrangement of a weight on a beam and the moment of inertia I, wherein the weight having a weight n is arranged only at an extreme end of one of arms.
Figure 10B:
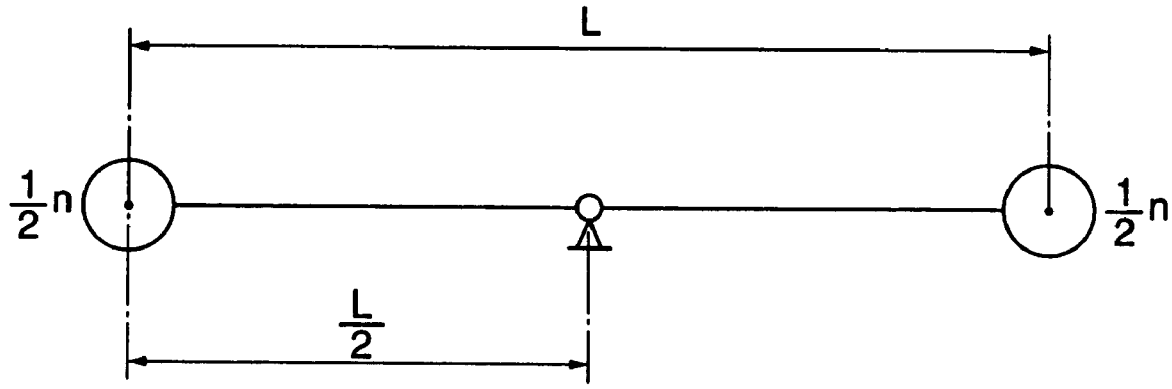
FIG. 10B shows the relationship between the arrangement of two weights on a beam and the moment of inertia I, wherein the two weights each having a weight n/2 are arranged at extreme ends of respective arms.

FIGS. 10A and 10B show the relationship between the arrangement of a weight member or weight members on a beam and the moment of inertia I acting on the beam.

AS shown in FIG. 10A, if a weight having a weight n is arranged only at an extreme end of one arm of a beam with an entire length of L, the beam having two arms each having a length of L/2 and extending leftward and rightward from a fulcrum of the beam, as viewed in the figure, the moment of inertia I acting on the beam is expressed by the equation of n×(L/2)2=nL2/4. On the other hand, as shown in FIG. 10B, when two weights each having a weight n/2 are arranged at the extreme ends of the respective arms, the moment of inertia I acting on the beam is expressed by the equation of 2×(n/2)×(L/2)2=nL2/4. That is, the total weight of the weights applied to the beam is equal to n, i.e. the weight of the weight in FIG. 10A, and the moment of inertia I is also equal to that in FIG. 10A.

In the keyboard assembly of the present embodiment, the above principle is utilized, i.e. by arranging the weights FRW, BUW formed of an identical material separately in the head portion 46 and in the tail portion 47, respectively (analogous to the example in FIG. 10B), the volume or size of each of the weight members is relatively reduced compared with that of the weight member arranged in one of the head portion 46 and the tail portion 47 (analogous to the example in FIG. 10A). This saves space in the keyboard assembly in the direction of height.

Figure 11A:
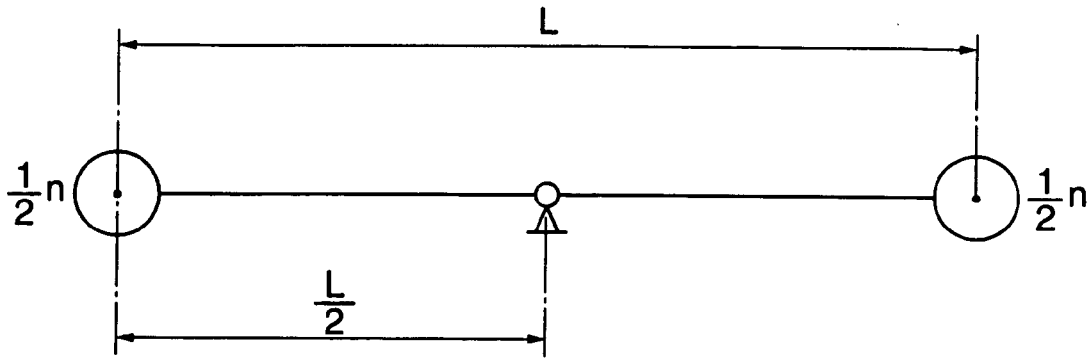
FIG. 11A shows the relationship between arm lengths of a beam from a fulcrum thereof and the moment of inertia wherein two weights each having a weight n/2 are arranged at extreme ends of respective arms each having a length of L/2.
Figure 11B:
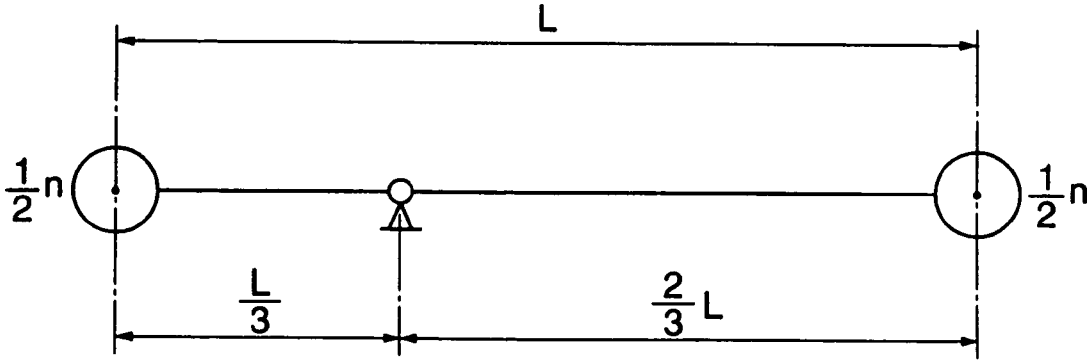
FIG. 11B shows the relationship between arm lengths of a beam from a fulcrum thereof and the moment of inertia I, wherein two weights each having a weight n/2 are arranged at extreme ends of respective arms having a length of L/2 and a length of 2L/3, respectively.

Further, according to the present embodiment, since the distance LF between the center of gravity FP of the front weight FRW and the center of the pivot-receiving portions 45 is shorter than the distance LB between the center of gravity BP of the back weight BUW and the center of the pivot-receiving portions 45 as shown in FIG. 5, it is possible to employ weight members lighter in weight while obtaining the same moment of inertia as in a case where the distances LF and LB are set equally, as will be explained below with reference to FIGS. 11A, 11B.

FIGS. 11A, 11B show the relationship between arm lengths from a fulcrum on a beam and the moment of inertia I.

If weights each having a weight n/2 are arranged, as shown in FIG. 11A, at the extreme ends of respective two arms of a beam with an entire length of L, the two arms each having a length of L/2 from the fulcrum, the moment of inertia I acting on the beam is expressed by the equation of $2\times(n/2)\times(L/2)2=nL2/4$. On the other hand, if weights each having a weight n/2 are arranged, as shown in FIG. 11B, at the extreme ends of respective two arms of a beam, the two arms having a length of L/3 and a length of 2L/3, respectively, the moment of inertia I acting on the beam is expressed by the equation of $(n/2)\times(L/3)2+(n/2)\times(2L/3)2=5nL2/18$. That is, although the entire lengths of the respective two beams are L and identical to each other, and the total weights of the respective two pairs of weights are n and identical to each other, the moment of inertia I acting on the beam in FIG. 11B is larger than that acting on the beam in FIG. 11A ($nL2/4<5nL2/18$). In short, by making the two arms different in length, rather than by equalizing the two arms in length, it is possible to employ a pair of weights having a smaller total weight and obtain the same moment of inertia as can be obtained by a pair of weights having a larger total weight.

In the keyboard assembly of the present embodiment, the above principle is utilized, i.e. by using the weights FRW, BUW formed of an identical material and making the distances LF and LB different from each other, it is possible to employ weight members lighter in weight while obtaining the same moment of inertia as can be obtained when the distances LF and LB are set equally.

Further, according to the present embodiment, since the distance LF is set to a distance shorter than the distance LB, it is possible to reduce a vertical travel distance of the head portion 46 of each mass member 40. In this embodiment, as described above, during a full depression stroke of each key, the top surface 46*d* of the head portion 46 of a corresponding mass member 40 is at its highest level when the mass member 40 is in the pivotal movement-completing position. Therefore, the reduction of the vertical travel distance of the head portion 46 of each mass member 40 makes it possible to limit a pop-up position which the front upper side surface 46*d* reaches when the head portion 46 pops up to a relatively low level, thereby saving the vertical space within the keyboard assembly.

Moreover, since the moment of inertia I acting on each mass member 40 can be obtained by utilizing a relatively small weight by setting the distances LF and LB to respective different distances and arranging the respective weights FRW, BUW separately in the head portion 46 and the tail portion 47, it is possible to design the respective weights FRW, BUW such that they have reduced sizes. This facilitates preventing interference between the weights FRW, BUW and keys 1 adjacent to the mass member 40 from occurring at or in the vicinity of the abutment portion between the tone-generating position adjustment screw 41 of the mass member 40 and the driving portion 9 of the corresponding key 1, whereby the degree of freedom in designing the mass member 40 is ensured. Thus, mass distribution can be readily adjusted, which facilitates key scaling to key-touch response.

Further, since an arbitrary combination of two weights FRW, BUW is selected as desired and attached to each mass member 40, it is possible to set a proper key-touch response simply by changing the combination of weights. Therefore, key scaling to the key-touch response of each key can be easily performed by properly setting mass distribution over each mass member 40. Moreover, the weight of the front weight FRW can be selectively set to any one of a plurality of weight levels simply by selecting the size of the hole FRWa and the thickness Ft in accordance with a desired weight, and the weight of each back weight BUW can also be selectively set to any one of a plurality of weight levels by setting the thickness Bt in accordance with a desired weight. This make it possible to easily set a desired key-touch response of each key.

Still further, the plural kinds of the front weight FRW have a substantially identical outer shape FRWe in spite of their respective different weights, and the plural kinds of the back weight BUW also have a substantially identical outer shape in spite of their respective different weights. As a resut, there is no difficulty in mounting them to the head portion 46 and the tail portion 47, thereby preserving ease of mounting operation of the weights FRW, BUW in the mass member 40. This makes it unnecessary to change the configuration of the hollow weight-mounting portion 46*e* or 47*e* on a mass member-by-mass member basis. Moreover, as described hereinbefore, the resin-made portion (including the abutment portion 44 and the actuator 42) is identical or uniform between mass members 40. Since the projecting amount of the tone-generating position adjustment screw 41 is fixed or uniform between mass members 40 when they are manufactured, the screws 41 can have an identical configuration. This permits the whole mass members 40 except the weights FRW, BUW to be manufactured in an identical or uniform configuration, and simplify the construction of the keyboard assembly.

As described heretofore, according to the present invention, it is possible to reduce the height of the keyboard assembly and ensure the degree of freedom in designing the keyboard assembly, thereby facilitating key scaling to key-touch response. At the same time, the mass members can have a body identical in configuration, and this makes it possible to simplify the configuration of the mass members, facilitate the manufacture of the same including the assembly work, and reduce the manufacturing costs of the keyboard assembly.

Next, the method of manufacturing the front weight FRW and the back weight BUW will be described. The weights FRW and BUW can be manufactured by a similar process, so that a description will be given of the method of manufacturing the front weight FRW alone.

Figure 12:
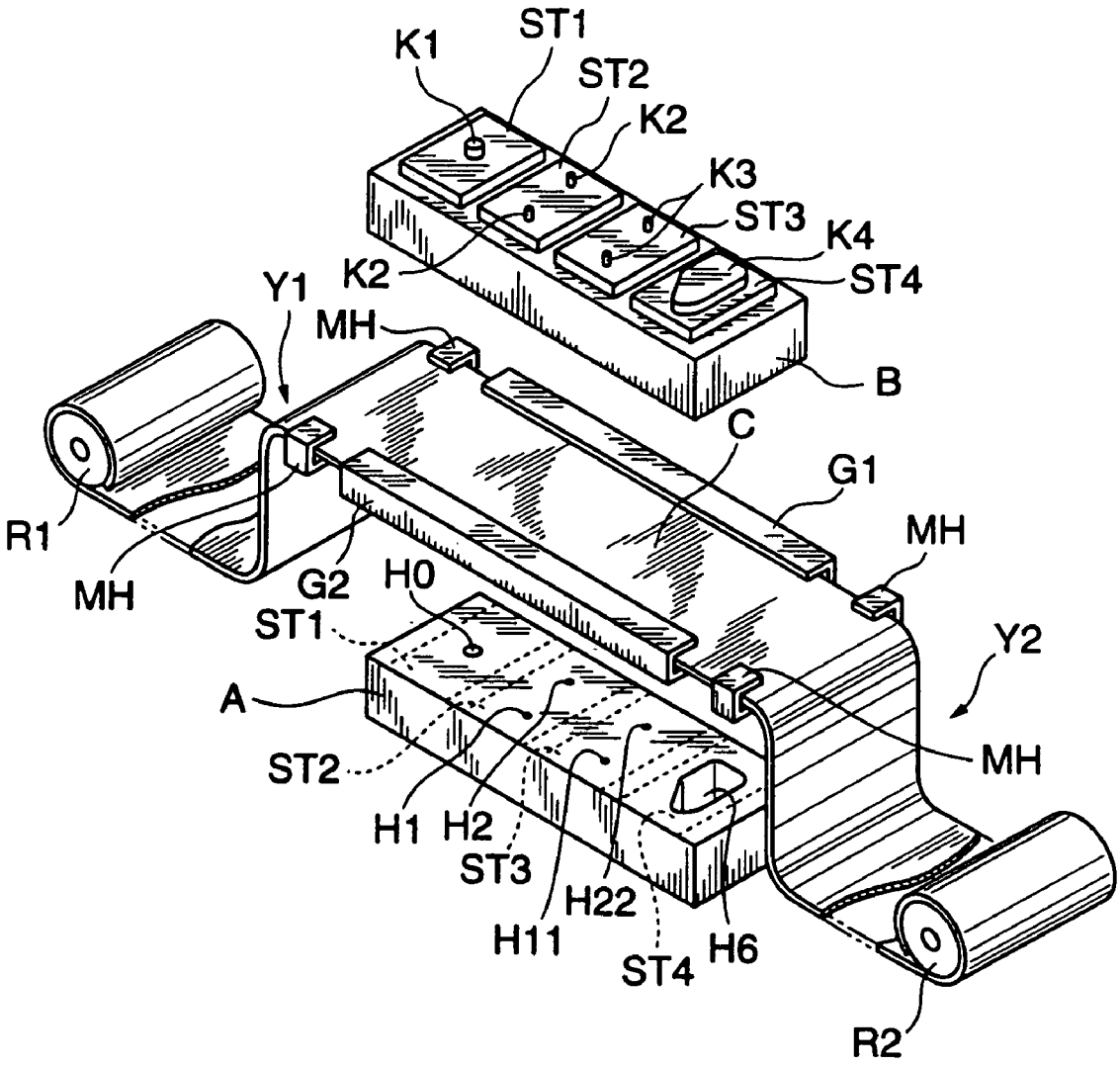
FIG. 12 is a perspective view of an example of a weight manufacturing apparatus.

FIG. 12 is a perspective view of an example of the construction of a weight manufacturing apparatus.

The apparatus is capable of stamping an iron sheet material unwound from a roll into stamped sheet parts (hereinafter simply referred to as "the parts") and laminating the parts one upon another.

An iron sheet material SB having a width of several centimeters is unwound from a roll having a diameter of one meter or more wound around a supply roller R1, and fed rightward, as viewed in the figure, on a lower die A also serving as a work bench, while forming sagging portions Y1, Y2 on opposite sides of the lower die A, to a take-up roller R2 to be taken up thereon. The rollers R1, R2 rotate at a slow and constant speed. The rotational speeds of the two rollers are approximately equal to each other. A work portion C of the iron sheet material SB between the sagging portions Y1 and Y2 is guided by guides G1, G2 provided along opposite lateral sides of the work portion C, to be drawn intermittently by intermittent feed means, referred to hereinafter, in the take-up direction (rightward, as viewed in the figure).

Figure 13:
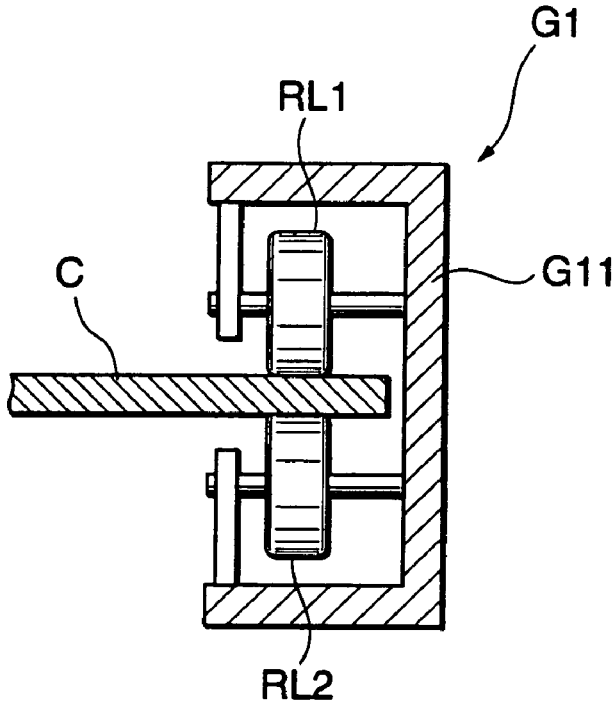
FIG. 13 is a fragmentary sectional view of a guide portion G1 of the weight manufacturing apparatus.

FIG. 13 is a sectional view of the guide portion G1.

As shown in the figure, the guide portion GI has upper and lower rollers RL1, RL2 rotatably secured to an inner wall of a cover portion 11 having an inverted C shape in cross section. The work portion C is sandwiched by the rollers RL1, RL2 with slight clearances between the rollers RL1, RL2 and the work portion C itself. The guide portion G2 is constructed similarly to and symmetrical with the guide portion G1.

In the present embodiment, the intermittent feed means is implemented by robot arms. More specifically, several portions of the work portion C of the iron sheet material SB are simultaneously held in a sandwiched manner by magic hands MH of the robot arms, each of which is formed by a pair of actuators opposed to each other and controlled by air pressure control, and the work portion C of the iron sheet material SB is instantaneously and intermittently advanced in a predetermined direction whenever a translation actuator, not shown, is energized.

It should be noted that the iron sheet material SB may be formed therein with guide holes arranged along opposite lateral sides of the iron sheet material SB in a dotted manner in the direction of feed of the iron sheet material SB, and feeding guide gears may be provided on a feeding side (leftward of the sagging portion Y2, as viewed in FIG. 12,), for engaging with the guide holes to feed the iron sheet material SB intermittently in the take-up direction (rightward as viewed in the figure). In either one of the above constructions, the average speed of the feed of the iron sheet material SB is controlled to be equal to the rotational speed of the rollers R1, R2 so that the amount of sagging of the sagging portions Y1, Y2 is kept substantially constant.

Above the lower die A, there is arranged an upper die B in opposed relation to the lower die A. The upper die B can be moved slightly in the vertical direction. The present die assembly including the upper and lower dies A, B has four stages used for respective different steps.

Through holes h1, h2 in each of the front weights FRW appearing in FIGS. 6A to 6C are formed only in a first part or piece for use as a base for lamination. Lamination-retaining half-punched portions h11, h22 are formed in second and subsequent parts or pieces. Each of the half-punched portions h11, h22 of the second or subsequent part or piece has a projection to be fitted in a through hole h1 of h2 of the first part or a half-punched portion h11 or h12 of a part immediately thereunder and caulked to be secured therein, as described in detail hereinafter.

The lower die A has first to fourth stages ST1 to ST4 arranged from the left side to the right side as viewed in FIG. 12. The first stage ST1 is provided with a cavity blade HO corresponding to the hole FRWa of a front weight FRW. The second stage ST2 is provided with small cavity blades H1, H2 corresponding to the respective through holes h1, h2 of a front weight FRW. The third stage ST3 is provided with small cavity blades H11, H12 corresponding the respective lamination-retaining half-punched portions h11, h22 of a front weight FRW. Further, the fourth stage ST4 is provided with a large cavity blade H6 corresponding to the outer periphery FRWe of a front weight FRW.

On the other hand, the upper die B has a first stage ST1 provided with a protruding actuator blade K1 corresponding to the cavity blade H0, a second stage ST2 provided actuator blades K2 corresponding to the respective small cavity blades H1, H2, a third stage ST3 provided with actuator blades K3 corresponding to the respective small cavity blades H11, H12, and a fourth stage ST4 provided with an actuator blade K4 corresponding to the large cavity blade H6. The actuator blades K1 to K4 are mounted to the upper die B in a manner vertically movable and in opposed relation to the respective corresponding blades H0, H1, H2, H11, H12 and H6 of the lower die A.

The second stage ST2 of the die assembly is operated exclusively for forming a part to be used as the base, and not operated when the other parts are formed. The third stage ST3 is operated for forming the parts except the base part.

Figure 14:
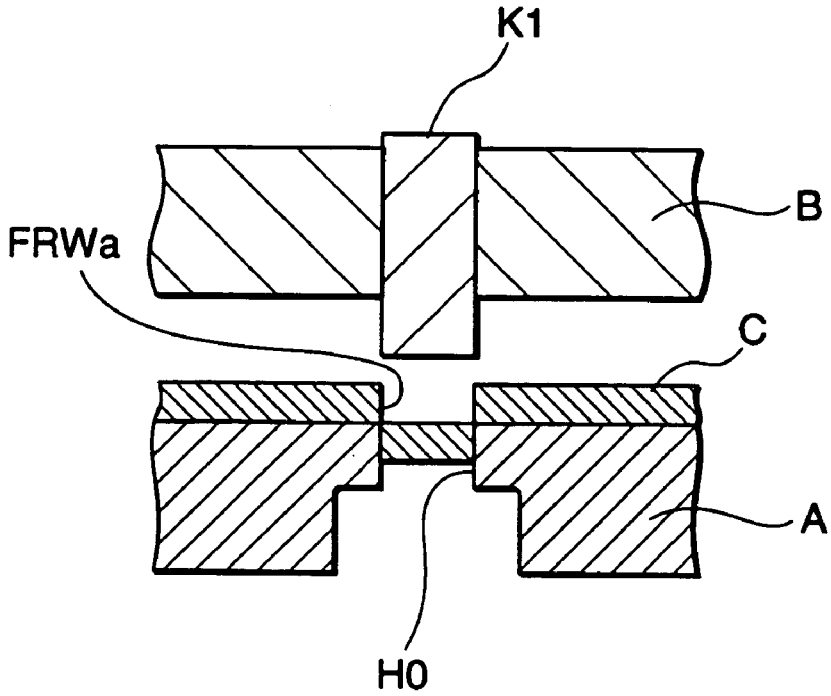
FIG. 14 is a fragmentary sectional view of a first stage ST1 of the weight manufacturing apparatus.
Figure 15:
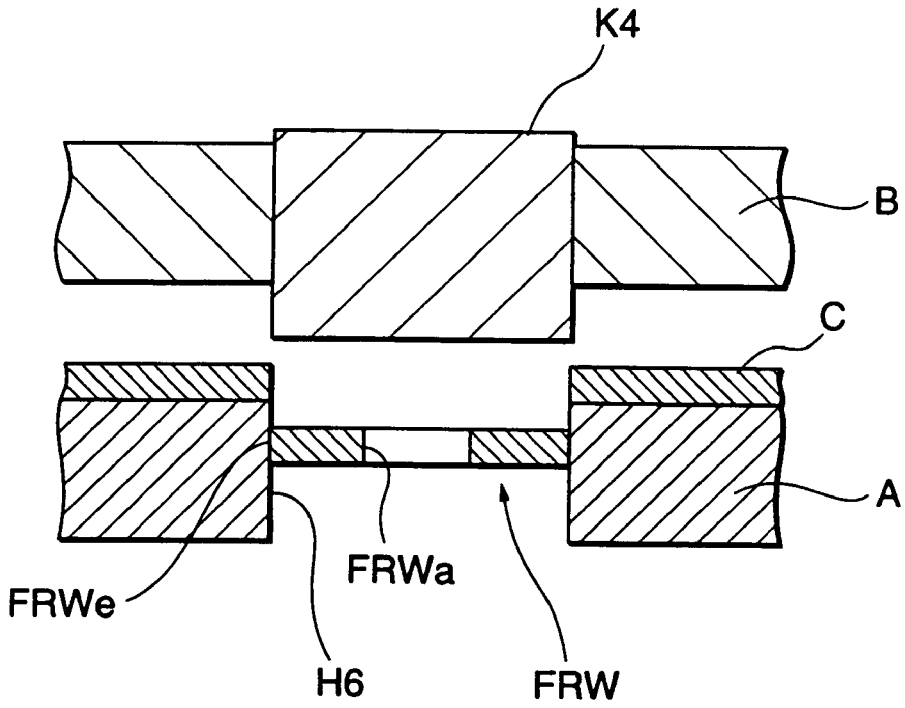
FIG. 15 is a fragmentary sectional view of a fourth stage ST4 of the weight manufacturing apparatus.

FIG. 14 shows essential parts of the first stage ST1 of the die assembly in cross section, while FIG. 15 shows. essential parts of the fourth stage ST1 of the same in cross section.

The iron sheet material SB is intermittently fed or advanced from the left side to the right side on the lower die A and subjected to simultaneous punching or sequential punching (the four stages are sequentially operated one by one at intervals of 0.25 sec.) by punching operations carried out between the upper and lower dies A, B.

For instance, to manufacture a base part as the lowermost layer of a front weight FRW having a laminate structure, the iron sheet material SB is fed by the robot arms until a portion of the iron sheet material SB to be punched reaches a predetermined position at the first stage ST1, and the work portion C is placed on the lower die A with the iron sheet material SB being held by the robot arms. Then, the upper die B is slightly lowered such that the work portion C is sandwiched between the lower and upper dies A and B. In this state, the blade K1 is moved downward upon energization. Thus, a hole FRWa is formed at a predetermined location by punching by the blades H0 and K1 as shown in FIG. 14. Then, the robot arms release the work portion C and shift their positions for holding the iron sheet material SB leftward from the immediately preceding position to move the work portion C rightward until a portion of the work portion C to be punched reaches a predetermined position for punching through holes h1, h2. At the second stage ST2, the through holes h1, h2 are formed by punching by the small blades H1, H2 and the blades K2, in a manner similar to that shown in FIG. 14 (though the holes h1, h2 are different in position and diameter from the hole FRWa).

Then, the work portion C is shifted rightward. At the third stage, the actuator is stopped, so that nothing is operated. Then, the work portion C is further shifted rightward. At the fourth stage ST4, the periphery FRWe is cut out by the large cavity blade H6 and the blade K6, whereby the base part is obtained as shown in FIG. 15.

Figure 16:
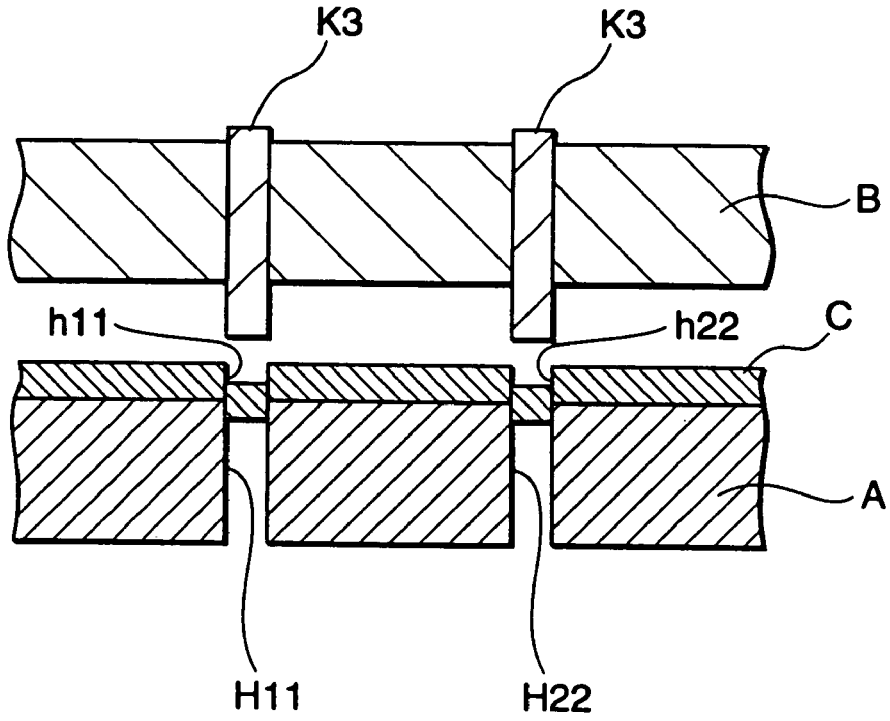
FIG. 16 is a fragmentary sectional view of a third stage ST3 of the weight manufacturing apparatus.
Figure 17A:
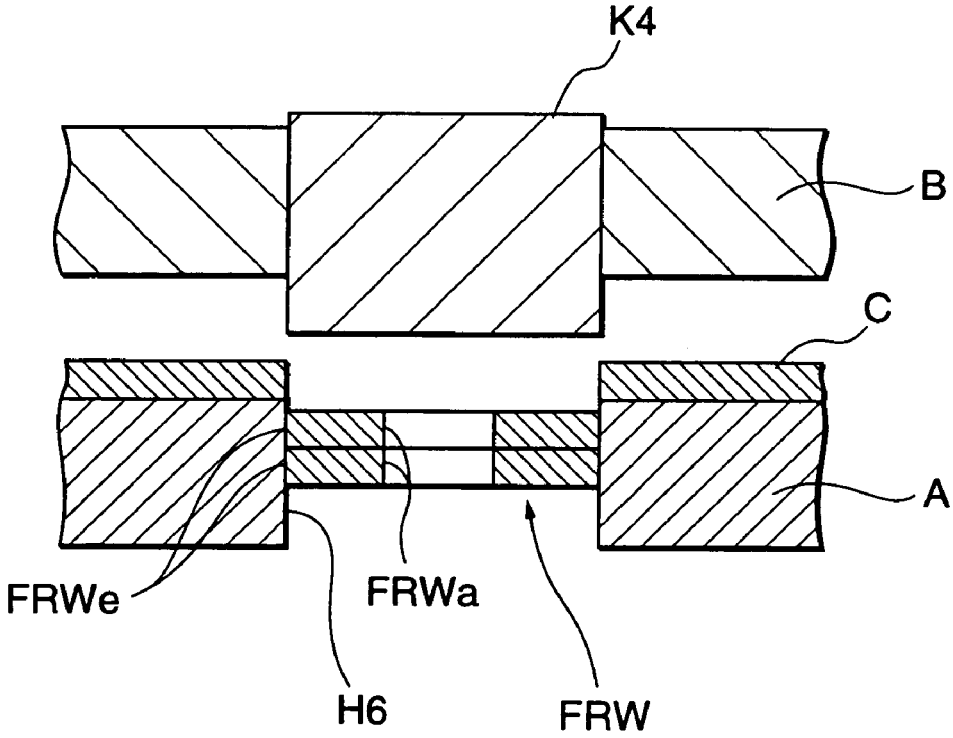
FIG. 17A is a fragmentary sectional view of the fourth stage ST4 of the weight manufacturing apparatus.

FIG. 16 shows essential parts of the third stage ST3 in cross section, while FIG. 17A shows essential parts of the fourth stage ST4 in cross section. Further, FIG. 17B shows a front weight-receiving box.

To manufacture a part other than the base, first at the first stage ST1, a hole FRWa is punched similarly to the case of forming the base part, and then a corresponding work portion C is shifted rightward. At the second stage ST2, nothing is operated, and then the work portion C is further shifted rightward. At the third stage ST3, as shown in FIG. 16, lamination-retaining half-punched portions h11, h22 are formed by the small cavity blades H11, H22 and the actuator blades K3.

Then, the work portion C is shifted rightward, and at the fourth stage ST4, by fitting the blade K into the recess of the large cavity blade H6 (punching), a part of the work portion C is cut out along an outer periphery FRWe thereof which is located radially outward of the half-punched portions h11, h22 to obtain a part having the half-punched portions h11, h22, followed by the part thus obtained being placed on a part (i.e. a (n−1)th part) which was formed in the immediately preceding process, as shown in FIG. 17A. At this time, if the (n−1)th part directly below is a base part, the downwardly projected half-punched portions h11, h22 are press-fitted into the respective through holes h1, h2 of the base part, and the two parts are caulked and fixed to each other. On the other hand, if the (n−1)th part directly below is not a base part, the downward projections of the half-punched portions h11, h22 are press-fitted into respective upwardly open recesses of the half-punched portions h11, h22 of the part directly below, and the two parts are caulked and fixed to each other.

Figure 17B:
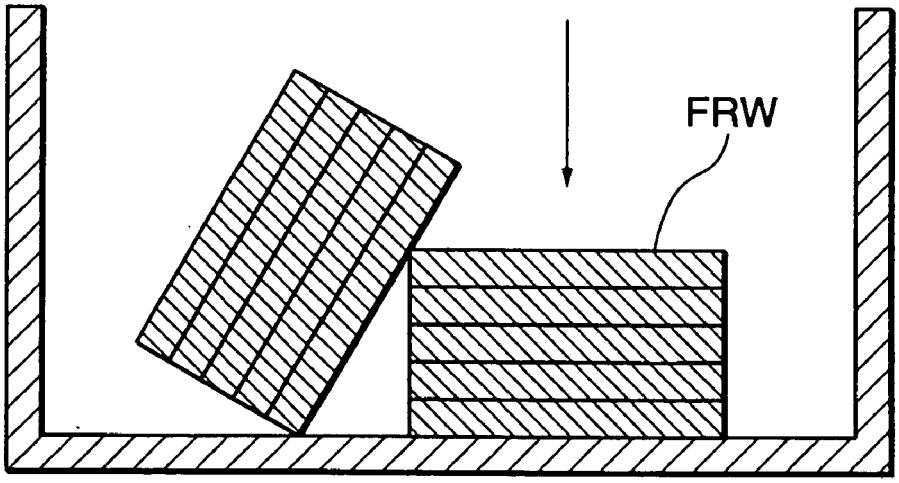
FIG. 17B is a sectional view of a front weight-receiving box.

When the predetermined number of parts are all laminated one upon another, the recess of the large cavity blade H6 of the lower die A is expanded in an opening direction, and the manufactured front weight FRW falls out of the recess of the large cavity blade H6 by gravity and received in the receiving box shown in FIG. 17B. Thereafter, the following process for manufacturing another front weight FRW is started.

These operations may be carried out by sequence control as follows: Three kinds of punching operation are carried out at the first to fourth stages one after another at intervals of approximately 0.25 sec. Then, upon lifting the upper die B, the robot arms change their positions for holding the work portion C and then shift the work portion C rightward by an amount corresponding to one stage. It takes e.g. approximately 1.0 sec to change the holding positions. This unit process of one holding operation and three punching operations is repeatedly carried out. Whenever the unit process is completed, a final layer or n-th part is formed to complete the lamination at the fourth stage.

According to the present embodiment, the above control process makes it possible to automatically form a front weight FRW or a back weight BUW by laminating a plurality of parts and caulking them to be fixed to each other. Therefore, the weights FRW and BUW can be easily manufactured without operations for fixing the parts with screws, which contributes to reduction of manufacturing costs. Further, since it is possible to adjust the weight of each weight member by changing the number of laminated parts, mass members 40 providing different types of inertia can be also easily manufactured. Thus, the present embodiment not only makes it possible to simplify the configuration of mass members 40, facilitate the manufacture of the same, and reduce manufacturing costs, but also makes it easy to accomplish key scaling to key-touch response.

Although in the above described embodiment, to obtain various kinds of front weights FRW different in weight, the size of the hole FRWa or the like formed in each front weight FRW is changed, this is not limitative, but the hollow portion in each front weight FRW for formation of the hole FRWa or the like can be made in any shape, e.g. a plurality of small holes or recesses, since the front weights are uniform in the shape of the periphery or outer shape while only the weight of each front weight FRW has to be changed. By changing the volumetric capacity of the hollow portion, the weight of each front weight FRW can be changed.

The weight of each front weight FRW may be set by changing only one of the hollow portion, such as the hole FRWa, and the thickness Ft. Further, the weight of each back weight BUW may be set only by providing a hollow portion therein and changing the volumetric capacity of the hollow portion, similarly to the front weight FRW, or by a combination of change of the volumetric capacity of the hollow portion and change of the thickness Bt. The above-mentioned combinations of values of the thickness Ft and shapes of the front weight FRW as well as the above-mentioned values of the thickness Bt of the back weight BUW are only given by way of example, and insofar as the configuration of the weight-receiving portions 46*e*, 47*e* can be made uniform between mass members 40 to a certain extent, the weight of each weight member may be changed by any other method.

Although in the above described embodiment, the mass members corresponding to all the keys of the keyboard assembly are made uniform in basic configuration, and key scaling is performed similarly on all the keys, this is not limitative, but the uniformity in configuration and execution of key scaling may be limited to mass members 40 for a plurality of octave sections. As a result, the mass members 40 within the octave sections can be made uniform in configuration, so that it is possible to obtain the same effects as can be obtained by the above embodiment, within the octave sections. In this case, key scaling may be performed on a plurality of keys within the plurality of octave sections, and preferably on all the keys of the keyboard assembly.

Although in the above described embodiment, the mass members 40 are all made identical or uniform in configuration except for the weight members, insofar as the abutment portion 44, the actuator 42 and the tone-generating position adjustment screw 41, i.e. the essential component parts of each mass member 40 are made as uniform in configuration as possible between the mass members 40, the remaining portions of the mass member 40 may be different in configuration to some extent.

The above described embodiment is directed to the uniformity in basic configuration of the mass members 40 of all the keys, and accomplishment of key scaling to key-touch response of all the keys. However, the white keys 1W are different from the black keys 1B, e.g. in length and adjustment of key-touch response between white keys 1W and black keys 1B can be more difficult to perform than that between white keys 1W or between black keys 1B. Therefore, the mass members 40 for a white key 1W and its adjacent black key 1B may be designed to have essential component parts thereof substantially uniform in configuration, and then the weights FRW, BUW of each of the mass members may be set so as to provide close key-touch responses between the adjacent white and black keys 1W, 1B, as described above. If this adjustment process is performed on pairs of adjacent white keys 1W and black keys 1B, key scaling to key-touch response of all the keys of the keyboard assembly can eventually be accomplished.

Further, although the electronic keyboard assembly according to the above described embodiment is constructed such that the driving portion 9 of each key 1 directly abuts the tone-generating position adjustment screw 41 of a corresponding mass member 40 to thereby drive the mass member for pivotal movement, an intermediate member may be provided between each key 1 and a corresponding mass member 40 so as to drive the mass member 40 indirectly. This cannot offer an obstacle to obtaining the effects provided by the invention.

What is claimed is:

1. An electric keyboard assembly comprising:

a plurality of white keys that are each pivotally moved by a key depressing operation;

a plurality of black keys that are each pivotally moved by a key depressing operation;

a plurality of seesaw-type mass members that each have a first arm and a second arm each extending from a pivotal center of the mass member, said plurality of mass members being disposed in a manner associated with said plurality of white keys and black keys, respectively, and being each pivotally moved about said pivotal center when a corresponding one of said plurality of white keys or black keys is depressed, said plurality of mass members each having a resin portion, said resin portion of one of said mass members associated with one of said white keys being substantially identical in configuration with said resin portion of another of said mass members associated with one of said black keys which is adjacent to said one of said white keys; and a plurality of insert weight members that are carried respectively by said first and second arms of each of said mass members, and wherein said insert weight members have respective weights thereof set separately from each other, such that key-touch responses of said one of said white keys and said one of said black keys adjacent thereto are made similar to each other.

2. An electric keyboard assembly comprising:

a plurality of keys that are each pivotally moved by a key depressing operation;

a plurality of mass members that each have a body, and are disposed in a manner associated with said plurality of keys, respectively, said plurality of mass members being each pivotally moved about a pivotal center thereof when a corresponding one of said plurality of keys is depressed, said body of each of said plurality of mass members being formed of resin and having at least one hollow weight-mounting portion formed therein; and at least one weight member that is mounted in said at least one hollow weight-mounting portion, said at least one weight member each having a hollow portion formed therein, and wherein said hollow portion of said at least one weight member of each of said plurality of mass members having a volumetric capacity thereof set separately from each other so as to accomplish key scaling to key-touch response.

3. An electric keyboard assembly comprising:

a plurality of keys that are each pivotally moved by a key depressing operation;

a plurality of seesaw-type mass members that each have a body, and first and second arms extending in opposite directions from a pivotal center thereof, said plurality of mass members being disposed in a manner associated with said plurality of keys, respectively, said plurality of mass members being each pivotally moved about said pivotal center when a corresponding one of said plurality of keys is depressed, said body of each of said plurality of mass members being formed of resin, said body including a follower for receiving a driving force generated by said key depressing operation, a stopper abutment portion for abutment with a stopper for setting a pivotal movement-completing position of said mass member, and a sensor depressing portion for depressing a sensor for detecting said key depressing operation, each of said plurality of mass members having first and second weight-mounting portions formed in said first and second arms, respectively; and first and second insert weight members that are carried by said first and second weight-mounting portions, respectively, and wherein said follower, said stopper abutment portion, and said sensor depressing portion each have an identical configuration between ones of said plurality of mass members for a plurality of octave sections, to thereby provide ease of operation of mounting said first and second insert weight members in a corresponding one of said plurality of mass members; and wherein a plurality of combinations of weights of said first and second insert weight members to be mounted in said first and second arms, respectively, are set between said ones of said plurality of mass members for said plurality of octave sections, while said mass members of each of the octave sections are identical in configuration with each other.

4. An electric keyboard assembly according to claim 3, wherein said first and second insert weight members each have an outer periphery and are formed of a sheet member, said outer periphery being configured such that it can be fitted in a corresponding one of said first and second weight-mounting portions of each of said plurality of mass members, and wherein said plurality of combinations of weights of said first and second insert weight members to be mounted in said first and second arms, respectively, can be set by at least one of changing weights of said first and second insert weight members and changing thickness of said first and second insert weight members, while maintaining said outer periphery identical in configuration between said first and second insert weight members.

5. A keyboard assembly comprising:

a plurality of pivotally movable members that each have a pivotally movable member body and are each pivotally moved by a key depressing operation; and a plurality of weight members each having an outer periphery and mounted in said plurality of pivotally movable members;

wherein said weight members mounted in said plurality of pivotally movable members are different in weight from each other so as to vary key-touch response between said keys or between groups of said keys during key depression, thereby accomplishing key scaling to key-touch response;

at least one of said weight members being formed of a plurality of weight component parts laminated one upon another and fixed together;

said plurality of weight component parts having a substantially identical outer shape in plan view;

said pivotally movable members being formed by outsert molding;

said outer periphery of each of said weight members being covered by resin outserted thereon;

said pivotally movable member body comprising an outserted portion covering said outer periphery of each of said weight members;

said weight members mounted in said pivotally movable members being different in weight between said keys or between key ranges.

6. A method of manufacturing a weight member mounted in a pivotally movable member provided in a keyboard assembly, said weight member comprising a plurality of weight component parts laminated one upon another, the method comprising the steps of:

intermittently moving a sheet member formed of a metal, and forming half-puched portions each having a projection on one side surface of said sheet member and a recess on an opposite side surface thereof, during stoppage of intermittent movement of said sheet member;

punching, using a cavity blade, a portion of said sheet member along an outer periphery thereof which is located radially outward of said half-punched portions to form each of said weight component parts having said half-punched portions, and sequentially laminating the formed weight component parts one upon another within said cavity blade such that the recesses or projections of the half-punched portions of an leading one of the weight component parts are fitted with the projections or recesses of the half-punched portions of a following one of the weight component parts; and removing said weight member formed of a predetermined number of said weight component parts laminated one upon another from said cavity blade when said predetermined number of said weight component parts are laminated one upon another.

7. A method according to claim 6, wherein said plurality of weight component parts have a substantially identical outer shape in plan view.

8. An electric keyboard assembly according to claim 1, wherein a distance between said pivotal center and a center of gravity of said insert weight member disposed in said first arm is set to a smaller value than a distance between said pivotal center and a center of gravity of said insert weight member disposed in said second arm.

* * * * *